US009199141B2

(12) United States Patent
Cardani et al.

(10) Patent No.: US 9,199,141 B2
(45) Date of Patent: Dec. 1, 2015

(54) BALL STRIKING DEVICE HAVING A COVERING ELEMENT

(71) Applicant: NIKE, Inc., Beaverton, OR (US)

(72) Inventors: Jason Cardani, Portland, OR (US); Jeremy Snyder, Benbrook, TX (US)

(73) Assignee: Nike, Inc., Beaverton, OR (US)

( * ) Notice: Subject to any disclaimer, the term of this patent is extended or adjusted under 35 U.S.C. 154(b) by 259 days.

(21) Appl. No.: 13/800,157

(22) Filed: Mar. 13, 2013

(65) Prior Publication Data

US 2014/0274456 A1 Sep. 18, 2014

(51) Int. Cl.

| | |
|---|---|
| ***A63B 53/04*** | (2015.01) |
| *A63B 59/00* | (2015.01) |
| *A63B 71/06* | (2006.01) |

(52) U.S. Cl.

CPC ..... *A63B 53/047* (2013.01); *A63B 59/0092* (2013.01); *A63B 2053/045* (2013.01); *A63B 2053/0408* (2013.01); *A63B 2053/0458* (2013.01); *A63B 2071/0694* (2013.01)

(58) Field of Classification Search

USPC ..... 473/324–350

See application file for complete search history.

(56) References Cited

U.S. PATENT DOCUMENTS

| | | | | | |
|---|---|---|---|---|---|
| 2,030,135 | A * | 2/1936 | Carpenter | 24/67 R |
| 3,257,677 | A * | 6/1966 | Batchelder et al. | 12/142 R |
| 3,869,333 | A * | 3/1975 | McMaster | 428/56 |
| 4,811,950 | A * | 3/1989 | Kobayashi | 473/335 |
| 4,928,972 | A * | 5/1990 | Nakanishi et al. | 473/332 |
| 5,052,113 | A * | 10/1991 | Aquino | 33/264 |
| 5,202,169 | A * | 4/1993 | Spendlove | 428/43 |
| 5,316,298 | A * | 5/1994 | Hutin et al. | 473/332 |
| 5,586,947 | A * | 12/1996 | Hutin | 473/324 |
| 5,588,923 | A * | 12/1996 | Schmidt et al. | 473/340 |
| 5,876,817 | A * | 3/1999 | Mathna et al. | 428/40.1 |
| 6,403,188 | B1 * | 6/2002 | Donahue | 428/40.1 |
| 6,649,239 | B2 * | 11/2003 | Donahue | 428/40.1 |
| 6,743,117 | B2 * | 6/2004 | Gilbert | 473/332 |
| 6,913,545 | B2 * | 7/2005 | Jones et al. | 473/342 |
| 6,973,759 | B2 * | 12/2005 | Trpkovski | 52/741.3 |
| 6,986,424 | B1 * | 1/2006 | Morrison | 206/703 |
| 7,087,699 | B2 * | 8/2006 | Kuntimaddi | 528/73 |
| 7,125,343 | B2 * | 10/2006 | Imamoto | 473/332 |
| 7,195,689 | B2 * | 3/2007 | Adams et al. | 156/252 |
| 7,338,387 | B2 * | 3/2008 | Nycum et al. | 473/332 |
| 7,383,954 | B2 * | 6/2008 | Morrison | 206/576 |
| 7,387,579 | B2 * | 6/2008 | Lin et al. | 473/332 |

(Continued)

FOREIGN PATENT DOCUMENTS

| | | | |
|---|---|---|---|
| JP | 2008125811 A | * | 6/2008 |
| JP | 2010035734 A | * | 2/2010 |

(Continued)

*Primary Examiner* — Alvin Hunter

(74) *Attorney, Agent, or Firm* — Banner & Witcoff, Ltd.

(57) ABSTRACT

A ball striking device may include a ball striking plate having a front surface configured to strike a ball and a rear surface opposite the front surface. The ball striking device may include a covering element located behind the rear surface. The covering element may be affixed to the rear surface of the ball striking plate with an adhesive member. The adhesive member may include a double-sided tape. Further, a thickened portion of the ball striking plate may be located behind a desired-contact region of the ball striking plate and the covering element may be affixed thereto. The covering element may be a highly-contoured element. The ball striking device may be a golf club head.

32 Claims, 10 Drawing Sheets

(56) References Cited

U.S. PATENT DOCUMENTS

| | | | | |
|---|---|---|---|---|
| 7,506,450 | B2 * | 3/2009 | Spaulding et al. | 33/286 |
| D608,631 | S * | 1/2010 | Preminger | D8/395 |
| 7,833,110 | B2 * | 11/2010 | Nakamura | 473/332 |
| 7,892,106 | B2 * | 2/2011 | Matsunaga | 473/290 |
| 8,267,807 | B2 * | 9/2012 | Takechi et al. | 473/332 |
| 8,333,667 | B2 * | 12/2012 | Kumamoto et al. | 473/342 |
| 8,864,603 | B2 * | 10/2014 | Kumamoto et al. | 473/332 |
| 8,870,682 | B2 * | 10/2014 | Roach | 473/349 |
| 8,876,630 | B2 * | 11/2014 | Takechi | 473/332 |
| 2004/0242339 | A1 * | 12/2004 | Gilbert et al. | 473/291 |
| 2008/0058119 | A1 * | 3/2008 | Soracco et al. | 473/350 |
| 2009/0118037 | A1 * | 5/2009 | Roach et al. | 473/349 |

FOREIGN PATENT DOCUMENTS

| | | | |
|---|---|---|---|
| JP | 2010115318 | A * | 5/2010 |
| JP | 2010131093 | A * | 6/2010 |
| JP | 2010154887 | A * | 7/2010 |
| JP | 2010216035 | A * | 9/2010 |
| JP | 2012213455 | A * | 11/2012 |

* cited by examiner

BALL STRIKING DEVICE HAVING A COVERING ELEMENT

TECHNICAL FIELD

The invention relates generally to ball striking devices having a covering element. Certain aspects of this invention relate to ball striking devices, such as golf clubs and golf club heads, having one or more covering elements affixed behind a rear surface of a ball striking plate.

BACKGROUND

The energy or velocity transferred to a ball by a ball striking device may be related, at least in part, to the flexibility of the face plate of the ball striking device at the point of contact, and can be expressed using a measurement called "coefficient of restitution" (or "COR"). Generally, the face plate of a ball striking device will have an area which imparts the greatest energy and velocity to the ball, and this area is typically positioned at or near the center of the ball striking plate. In one example related to golf clubs, the area of highest response may have a COR that is equal to the prevailing USGA limit (e.g. currently 0.83). Because golf clubs are typically designed to contact the ball at or around the center of the face plate, even slightly off-center hits with many existing golf clubs may result in less energy being transferred to the ball, decreasing the distance of the shot. Such off-center hits may also result in undesirable vibrations being felt and/or heard by the user.

The overall flexing behavior of the ball striking face plate and/or other portions of the ball striking device during impact may influence the energy and velocity transferred to the ball, the direction of ball flight after impact, the spin imparted to the ball, and the feel and sound of the ball striking device conveyed to the user, among other factors. Altering the flexing behavior of the face plate of the ball striking device may involve altering the geometry of the ball striking plate. For example, certain portions of the plate may be thickened or thinned. Certain portions of the plate may be provided with reinforcement features. Accordingly, altering the geometry of the ball striking face plate, itself, and/or other portions of the ball striking device during impact may be advantageous.

However, altering the geometry of the ball striking plate may affect the look, sound, and/or feel of the ball striking device, which may in turn affect the perceptions of the user of the ball striking device. Even minor changes may be disconcerting to the user. Accordingly, fine-tuning or "tweaking" the dynamic characteristics of the ball striking device may be advantageous.

Further, certain golf club heads may be formed from multiple components. Different means of joining elements to club head bodies are known. Each particular joining method must address issues concerning the strength of the attachment, the durability of the attachment, the ease of forming the attachment, the aesthetics of the attachment, etc.

The present devices and methods are provided to address at least some of the problems discussed above and other problems, and to provide advantages and aspects not provided by prior ball striking devices of this type. A full discussion of the features and advantages of the present invention is deferred to the following detailed description, which proceeds with reference to the accompanying drawings.

SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

According to aspects of the invention, a ball striking device includes a ball striking plate having a front surface configured to strike a ball and a rear surface opposite the front surface. The ball striking plate has a desired-contact region and a perimeter. The ball striking device further includes one or more covering elements located behind the rear surface. In one particular aspect, a first covering element may be located behind and affixed to the rear surface of the ball striking plate with an adhesive member. The adhesive member may include double-sided tape.

According to some aspects, the covering element may be affixed to the rear surface of the ball striking plate with a first double-sided tape having a first thickness and with a second double-sided tape having a second thickness. Optionally, the covering element may be affixed to the rear surface of the ball striking plate with a first double-sided tape having a first density and with a second double-sided tape having a second density.

According to certain aspects, the adhesive member may cover substantially the entire interior surface of the covering element, i.e., the surface that faces the rear surface of the ball striking plate.

According to other aspects, the adhesive member may cover first and second regions of the interior-facing surface of the covering element, wherein the first and second regions may be separated by a third region which is devoid of an adhesive member. The adhesive member in the first region may be a first double-sided tape. The adhesive member in the second region may be a second double-sided tape.

According to some aspects, the first region may correspond to a thickened portion projecting from the rear surface of the ball striking plate and positioned behind a desired-contact region of the ball striking plate. The adhesive member may include a first double-sided tape located in the first region and a second double-sided tape located in the second region, wherein the first double-sided tape may have a density that may be greater than a density of the second double-sided tape. Additionally, or alternatively, the first double-sided tape may have a thickness that may be less than a thickness of the second double-sided tape. According to certain other aspects, a first piece of the double-sided tape may have substantially the same shape as the thickened portion and may be affixed to the thickened portion.

According to even other aspects, the covering element may be a highly-contoured element having a maximum-to-minimum height ratio of greater than or equal to 5. Even further, the first covering element may have a maximum-to-minimum height ratio of greater than or equal to 8, or greater than or equal to 10.

According to some aspects, the ball striking plate has a frame extending rearwardly from the perimeter and the first covering element may be located within a cavity encompassed by the frame. When viewed from the back of the ball striking device, the covering element may extend across the opening of the cavity.

According to further aspects, a covering element for affixation to a golf club may be provided. The covering element may include a first surface configured for receiving an adhesive member and a second surface having a multi-level surface topography with a plurality of abrupt changes in the slope of the surface. The covering element may be a relatively lightweight element. For example, the covering element may weigh less than 12.0 gm.

According to additional aspects, a ball striking device may include a highly-contoured covering element having a maximum-to-minimum height ratio of greater than or equal to 5. The highly-contoured covering element may be affixed to the rear surface of the ball striking plate. In some embodiments, the covering element may be configured as shell-like element. Further, the covering element may include a cavity with a scaffolding-type element provided within therein.

The ball striking plate may be incorporated into a body to thereby form a golf club head and the body may be configured for engagement to a shaft to thereby form a golf club. In particular, an iron-type golf club head may be formed. A shaft may be engaged with the golf club head to form a golf club.

These and additional features and advantages disclosed here will be further understood from the following detailed disclosure taken in conjunction with the attached drawings.

BRIEF DESCRIPTION OF THE DRAWINGS

To allow for a more full understanding of the present invention, it will now be described by way of example, with reference to the following drawings.

Figure 1:
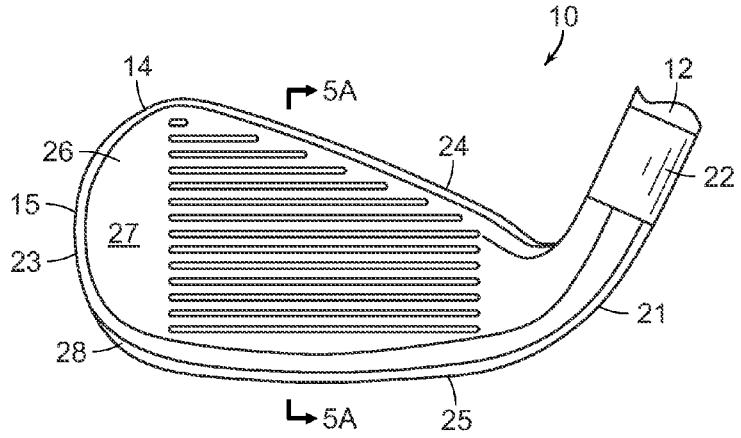
FIG. 1 is a front view of an embodiment of a ball striking device, in the form of an iron-type golf club head and having a shaft (partially shown) attached to form a golf club.

The various figures in this application illustrate examples of ball striking devices and portions thereof according to this invention. The figures referred to above are not necessarily drawn to scale, should be understood to provide a representation of particular embodiments of the invention, and are merely conceptual in nature and illustrative of the principles involved. Some features of the ball striking devices depicted in the drawings may have been enlarged or distorted relative to others to facilitate explanation and understanding. When the same reference number appears in more than one drawing, that reference number is used consistently in this specification and the drawings to refer to similar or identical components and features shown in the various alternative embodiments.

DETAILED DESCRIPTION

A general description of aspects of the invention followed by a more detailed description of specific embodiments follows. It is to be understood that other specific arrangements of parts, structures, example devices, systems, and steps may be utilized and structural and functional modifications may be made without departing from the scope of the present invention. It is expected that ball striking devices as disclosed herein would have configurations and components determined, in part, by the intended application and environment in which they are used. Thus, for certain specific embodiments the dimensions and/or other characteristics of the ball striking device structures according to aspects of this invention may vary significantly without departing from the invention.

The following terms are used in this specification, and unless otherwise noted or clear from the context, these terms have the meanings provided below.

"Ball striking device" means any device constructed and designed to strike a ball or other similar objects (such as a hockey puck). In addition to generically encompassing "ball striking heads," which are described in more detail below, examples of "ball striking devices" include, but are not limited to: golf clubs, putters, croquet mallets, polo mallets, baseball or softball bats, cricket bats, table tennis paddles, field hockey sticks, ice hockey sticks, and the like.

"Ball striking plate" means the portion of a "ball striking device" that includes and is located immediately adjacent (optionally surrounding) the portion of the ball striking device designed to contact the ball (or other object) in use. A ball striking plate includes a ball striking face. In some example ball striking devices, the ball striking plate may be formed as a separate and independent entity which is subsequently joined to the remainder of the ball striking device.

"Integral joining" means a technique for joining two pieces so that the two pieces effectively become a single, integral piece, including, but not limited to, irreversible joining techniques, such as adhesively joining, cementing, welding, brazing, soldering, or the like. In many bonds made by "integral joining," separation of the joined pieces cannot be accomplished without structural damage thereto.

"Approximately" incorporates a variation or error of +/−10% of the nominal value stated.

"Generally constant thickness" incorporates a variation or error of +/−5% of the average thickness over the entirety of the area in question.

"Desired-contact" region refers to the as-designed, optimal region of the ball striking plate for contacting the ball or other struck object. This "desired-contact" region is sometimes referred to, informally, as the "sweet spot." For purposes of this disclosure, the desired-contact region is considered to extend through the thickness of the ball striking plate, i.e., the region is not limited to the front surface of the ball striking plate. Although in some instances the desired-contact region may generally be centered on the geometric center of the ball striking plate, in other instances, the desired-contact region may be located off center. Further, the desired-contact region may be defined as the area of the ball striking plate that is capable of achieving at least 99.7% of the maximum ball speed achievable by the ball striking device. Alternatively, the desired-contact region may be defined as the area of the ball striking plate that is capable of achieving at least 99.5% or even at least 99.0% of the maximum ball speed achievable by the ball striking device. By way of example, for ball striking devices provided as driver-type golf clubs the desired-contact region may have an area generally ranging from approximately 50 $mm^2$ to approximately 250 $mm^2$. It is expected that other ball striking devices may have different areas of the desired-contact regions.

"Central" region, when referring to the ball striking plate, refers to a circular region generally centered on the geometric center of the ball striking plate. The central region may have an area generally greater than approximately 50 $mm^2$, greater than approximately 70 $mm^2$, greater than approximately 90 $mm^2$, greater than approximately 110 $mm^2$, greater than approximately 130 $mm^2$, greater than approximately 150 $mm^2$, or even greater than approximately 200 $mm^2$. In certain embodiments, the central region may have an area generally ranging from approximately 50 $mm^2$ to approximately 250 $mm^2$, from approximately 70 $mm^2$ to approximately 200 $mm^2$, or from approximately 90 $mm^2$ to approximately 200 $mm^2$.

The term "thickness" or "plate thickness," when used in reference to a ball striking plate as described herein refers to the distance between the front surface of the ball striking plate and the rear surface of the ball striking plate. The thickness is generally the distance between a point on the front surface of the ball striking plate and the nearest point on the rear surface of the plate, respectively, and may be measured perpendicularly to the front or rear surface at the point in question.

A. General Description of Ball Striking Devices and Ball Striking Plates According to Aspects of the Invention In general, aspects of this invention relate to ball striking devices having a ball striking plate. Such ball striking devices, according to at least some examples of the invention, may include a ball striking head and a shaft, wherein the head includes the ball striking plate.

Aspects of the invention relate to ball striking devices with a head that includes a ball striking plate configured for striking a ball. Various example structures include ball striking plates that are provided with reinforced or thickened areas. Thus, according to certain aspects, the thickness in certain areas of the striking plate may be increased (relative to a constant thickness striking plate) while the thickness in other areas may be reduced. For example, selective reinforcement of high stress areas may result in an overall weight reduction of the ball striking plate while maintaining the desired structural integrity of plate. The overall weight saved due to the reduced-thickness plate portions may be discretionarily placed elsewhere on the head, thereby allowing improved control of mass characteristics (e.g., moment-of-inertia, center-of-gravity, etc.) and/or vibration characteristics.

Specifically, various example structures of ball striking plates described herein may include a thickened portion that forms a raised platform or elevated area extending rearwardly from a rear surface of the striking plate. Thus, the striking plate may have an elevated or thickened area protruding from the rear surface and having increased thickness relative to a surrounding peripheral portion of the plate. The thickened portion may be positioned behind the geometric center of the striking plate. Further, the thickened portion may be positioned behind at least a portion of the desired-contact region or the central region of the striking plate. In some embodiments, the thickened portion may extend completely over and possibly beyond the perimeter of the desired-contact region or the central region of the striking plate. U.S. patent application Ser. No. 13/211,961, filed Aug. 17, 2011, titled "Golf Club or Other Ball Striking Device Having Stiffened Face Portion," which is incorporated by reference herein in its entirety and made part hereof, discloses thickened portions on rear surfaces of ball striking plates.

The thickened portions and/or elevated areas may have shapes that are elongated and may be elliptical or semi-elliptical, multi-lobed, or generally peanut- or kidney-shaped. In certain embodiments, the thickened portion may have an outer edge defining a shape that includes two lobes (i.e., a portion where the outer edge has a generally convex outer profile), and a connecting portion extending between the lobes. The connecting portion is defined by outer edges extending between the outer edges of the lobes, with at least one of the outer edges of the connecting portion having a concave profile. If only one of the outer edges of the connecting portion is concave, the resultant shape may be what is referred to as a kidney-shaped thickened portion. If both of the outer edges of the connecting portion are concave, the resultant shape may be what is referred to as a peanut-shaped thickened portion.

In general, the thickened portion and/or the elevated area may assume any shape. For example, the elevated level of the thickened portion may be generally circular, oval, elliptical, tear-drop shaped, pear shaped, square, rectangular, triangular, trapezoidal, polygonal (with or without rounded corners and/or with straight or curved edges). Further, the lobed shapes need not be limited to double-lobed shapes, but may be triple-lobed or quadruple-lobed (or with even a higher number of lobes). Even further, the thickened portion and/or the elevated area need not have a regular geometric shape, nor need it be symmetrically shaped. Thus, for example, the thickened portion and/or the elevated area may have an amorphous, curved, amoeba-like shape.

The thickened portion and/or the elevated area may be elongated along an axis of elongation. This axis of elongation would typically be coincident with the maximum planar dimension of the thickened portion and/or elevated area. The angle of the axis of elongation may be determined by understanding typical ball striking patterns. A typical angle (counterclockwise from the horizontal when viewed from the rear surface) for the axis of elongation may be between 0°-15° or 0°-20° (for example, for certain golf club heads). In various other embodiments, the angle for the axis of elongation may be limited to between 5°-15° or 5°-18°. It is to be understood that the thickened portion may have a different orientation and/or axis of elongation depending upon the specific ball striking device.

Additionally, according to some embodiments, the dimensions measured along a second axis perpendicular to the axis of elongation may vary. Thus, for example, a double-lobed thickened portion may have a first axis, wherein the lobes each have dimensions measured along a second axis perpendicular to the first axis, and the lobes are wider (i.e. have greater dimensions perpendicular to the axis of elongation) than the connecting area, which is narrowed with respect to the lobes. Optionally, the thickened portion may be a triple-lobed shape.

According to some aspects, the thickened portion may have a generally constant thickness. In certain embodiments, the elevated area may be a plateau area having a generally constant thickness over the entire area within the upper boundary of the annular or encircling tapered area. According to other embodiments, the elevated area need not be constant, but may be stepped, slanted, faceted, convexly domed, concave, etc.

Optionally, the thickened portion may further include a transition area that tapers in thickness between a first upper boundary (or upper contour edge) and a first lower boundary (or lower contour edge). The transition area may be an annular or encircling transition area that encloses or substantially encloses the elevated area. The change in thickness of this transition area as it extends from the upper contour edge to the lower contour edge may be constant (i.e. linear), may be curvilinear and/or may follow a regular mathematical relationship (i.e. parabolic, hyperbolic, semi-circular, semi-elliptical), may be instantaneous (e.g. a 90° drop), or may be irregular or may follow a different pattern. Additionally, the transition profile (i.e., the profile from the upper edge to the lower edge) of the transition area may be the same over the entirety of its annular extent or may be different in different locations of the annulus. At the lower boundary, the transition area may smoothly merge into the rear surface of the ball striking plate.

According to certain aspects, typically for golf clubs, the thickened portion of the ball striking plate may cover a total area that ranges from approximately 75 $mm^2$ to approximately 3000 $mm^2$. The lower end of the range may be more appropriate for irons, while the upper end of the range may be more appropriate for drivers. In some embodiments, the thickened portion of the striking plate may be very localized, such that it covers a total area that ranges only from approximately 75 $mm^2$ to approximately 150 $mm^2$ or, optionally, from approximately 75 $mm^2$ to approximately 250 $mm^2$. In some embodiments, the thickened portion may be less localized, such that it covers a total area that ranges from approximately 250 $mm^2$ to approximately 500 $mm^2$, from approximately 250 $mm^2$ to approximately 750 $mm^2$, or even from approximately 250 $mm^2$ to approximately 1000 $mm^2$. In other embodiments, the thickened portion of the ball striking plate may be somewhat larger, such that it covers a total area that ranges from approximately 750 $mm^2$ to approximately 1250 $mm^2$, from approximately 1000 $mm^2$ to approximately 1250 $mm^2$, or even from approximately 1000 $mm^2$ to approximately 1500 $mm^2$.

According to some aspects, the thickened portion may have a maximum thickness of approximately 2.00 mm to approximately 4.50 mm. These example thicknesses may be particularly appropriate for golf club ball striking plates formed of metal (i.e., titanium alloys, stainless steel, etc.). More typically, the thickened portion may have a maximum thickness of approximately 2.50 mm to approximately 4.00 mm. Alternatively, the thickened portion may have a maximum thickness of approximately 2.25 mm to approximately 3.75 mm, a maximum thickness of approximately 2.50 mm to approximately 3.5 mm, or even a maximum thickness of approximately 2.50 mm to approximately 3.25 mm. As noted above, this thickness may be substantially constant in the elevated areas 132. Further, these thicknesses may be especially suitable for golf clubs having metallic ball striking plates.

Generally, a peripheral portion extends from the thickened portion to a perimeter of the ball striking plate. The perimeter of the ball striking plate may be coincident with an inner edge of a frame extending at least partially around the ball striking plate. The peripheral portion may have a constant thickness or a varying thickness. In any event, a minimum thickness for the peripheral portion may be determined. According to some aspects, the peripheral portion may have a minimum thickness of approximately 1.20 mm to approximately 2.50 mm. More typically, the peripheral portion may have a minimum thickness of approximately 1.40 mm to approximately 2.10 mm. Alternatively, the peripheral portion may have a minimum thickness of approximately 1.50 mm to approximately 2.00 mm, a minimum thickness of approximately 1.60 mm to approximately 1.90 mm, or even a minimum thickness of approximately 1.65 mm to approximately 1.85 mm. These thicknesses may be especially suitable for golf clubs having metallic ball striking plates.

Alternatively, the maximum thickness of the thickened portion may be disclosed as an increase in thickness relative to a minimum thickness of the surrounding peripheral portion. Thus, according to some embodiments, the maximum thickness of the thickened portion may range from 125% to 200% of the minimum thickness of the surrounding peripheral portion, i.e., the increase in thickness may range from 25% to 100% of the minimum thickness. For example, if the maximum thickness is 175% of the minimum thickness, and if the minimum thickness of the peripheral region was approximately 1.90 mm, then the maximum thickness of the thickened portion would be approximately 3.33 mm.

According to even other aspects, the total volume of material in the thickened portion of the ball striking plate may be a consideration. For example, should the thickened portion have an area of 500 $mm^2$ and a constant thickness of 3.00 mm, the total volume of the thickened portion would be 1.50 $cm^3$. In general, for certain golf club heads, a total volume of the thickened portion of the ball striking plate of between 0.50 $cm^3$ and 2.50 $cm^3$ may be desirable, particularly if the ball striking plate is formed of a metal such as steel or titanium. Optionally, a total volume of the thickened portion between 0.50 $cm^3$ and 1.00 $cm^3$ for lightly loaded ball striking plates may be desirable, while a total volume of the thickened portion between 1.50 $cm^3$ and 2.50 $cm^3$ for more severely loaded ball striking plates may be more appropriate.

The thickened portion described herein may provide increased energy transfer and ball velocity for impacts between the ball striking surface and a ball. The thickened portion may create a stiffened center portion of the ball striking plate, which permits other areas of the plate to be made more flexible (such as by decreasing the thickness). This may result in a more gradual impact (longer dwell time) with the ball, which in turn may decrease overall ball deformation. Because significant energy loss can occur with excessive ball deformation, the reinforced configuration of the ball striking plate may result in less overall energy loss and greater energy and velocity upon impact.

In certain embodiments, a frame may extend rearwardly from the perimeter of the ball striking plate. The frame in conjunction with the striking plate may have a cup-like configuration, with walls extending rearwardly from the entire perimeter of striking plate. Optionally, the frame in conjunction with the ball striking plate may have a generally U-shaped cross-sectional configuration, with the frame extending rearwardly from both a top section and a bottom section of the perimeter edges of striking plate. In certain embodiments, the frame in conjunction with plate may have a generally L-shaped cross-sectional configuration, i.e., the frame extends rearwardly from just one of the top section or bottom section perimeter edges of the ball striking plate.

The frame (if any) around the ball striking plate and/or other portions of the ball striking device may flex during impact to cooperate with the ball striking plate to reduce ball deformation and thereby increase the return energy and velocity on impact. Additionally, the stiffened center portion and more flexible peripheral portions of the ball striking plate may increase the trampoline effect of the plate. The thickened portion may also reduce stresses and strains in the ball striking plate, thereby increasing the durability and usable life of the plate. Still further benefits may be recognized and appreciated by those skilled in the art.

According to various aspects of this invention, the ball striking plate, frame, and/or other components of the ball striking device may be formed of one or more of a variety of materials, such as metals (including metal alloys), ceramics, polymers, composites, fiber-reinforced composites, and wood, and the devices may be formed in one of a variety of configurations, without departing from the scope of the invention. In one embodiment, some or all components of the head, including the face and at least a portion of the body of the head, are made of metal materials. It is understood that the head also may contain components made of several different materials. Additionally, the components may be formed by various forming methods. For example, metal components (such as titanium, aluminum, titanium alloys, aluminum alloys, steels (such as stainless steels), and the like) may be formed by forging, molding, casting, stamping, machining, and/or other known techniques. In another example, composite components, such as carbon fiber-polymer composites, can be manufactured by a variety of composite processing techniques, such as pre-preg processing, powder-based techniques, mold infiltration, and/or other known techniques. Also, if desired, the club heads may be made from any number of pieces (e.g., having a separate face plate, etc.) and/or by any construction technique, including, for example, casting, forging, welding, and/or other methods known and used in the art.

Additional aspects of the invention relate to ball striking devices provided with one or more covering elements located behind the rear surface of the ball striking plate.

In certain embodiments of ball striking devices, the ball striking plate and/or the ball striking device may be formed as a plate-like element. In other embodiments, a frame may extend rearwardly from at least a portion of the perimeter of the ball striking plate. The frame in conjunction with the ball striking plate may provide a cup-like configuration, with walls extending rearwardly from the entire perimeter of the ball striking plate. The frame may form a perimeter boundary that at least partially defines a cavity. In some embodiments, the frame may be used to assist in the retention of the covering element to the ball striking device.

When the ball striking device is configured as an iron-type golf club, covering elements as described below may generally be applied to blade-type irons, muscle-back irons, cavity-back irons, partial cavity-back irons, etc. When the covering element is located within a perimeter frame as may be provided with a cavity-back type iron, the covering element may be visible from the back of the iron.

Various covering elements may be provided as protective elements, decorative elements, informational elements, weighting elements, reinforcing elements, and/or a combination thereof. According to some aspects, certain covering elements may completely cover or enclose the rear surface of the ball striking plate. As such, these covering elements may be considered to be protective elements. Others may only partially cover or extend over the rear surface of the ball striking plate. For example, the covering element may be located behind the region of the ball striking plate associated with the desired-point-of-contact. These also may be considered to be protective elements, if for example, they extend over an area of the rear surface that it may be desirable to protect or shelter from the environment. More than one covering element may be provided to cover or at least partially extend over the rear surface of the ball striking plate. Certain covering elements may be supplied as decorative elements and may include bright colors, interesting surface finishes or textures, embossed features, etc. For example, decorative covering elements may be supplied as medallions. These covering elements may have, or may appear to have, very high-relief, three-dimensional, surface topography. Some covering elements may be supplied as informational elements and may include manufacturer's logos, alignment marks, weight designations, iron identifications, loft angles, owner's names, etc. Generally, any given covering element may be expected to perform multiple functions.

Further, various covering elements may influence the dynamic response characteristics of the ball striking plate such that vibrations felt or heard by the user may be modified. These covering elements may be provided with specific vibration transmission and/or damping characteristics. Such characteristics may be governed by the material(s), physical configurations, and manufacturing techniques used to form any given covering element. Additionally, the means for affixing the covering elements to the ball striking device may also be designed to provide specific vibration transmission and/or damping characteristics.

Thus, for example, certain covering elements may be attached or affixed directly to the rear surface of the ball striking plate. According to certain embodiments, a covering element may extend over substantially the entire rear surface (or over substantially the entire rear surface) of the ball striking plate. For example, a covering element may extend over 90% or even over 95% of the area of the rear surface. Optionally, a covering element may extend over a majority of the rear surface of the ball striking plate. By way of example, a covering element may extend over at least 50%, over 60%, over 70% or even over 80% of the area of the rear surface of the ball striking plate.

In other embodiments, certain covering elements may be attached or affixed to portions of the ball striking device other than the rear surface of the ball striking plate. In certain embodiments, affixing the one or more covering elements may seal the rear surface from the surrounding environment.

In some embodiments, certain covering elements may be permanently joined to the ball striking device. In even other embodiments, the covering elements may be removably affixed behind the ball striking plate.

In some embodiments, adhesives members may include liquid-type adhesives (such as epoxies, glues, cements, putties, pastes, etc.) to affix the covering element to the ball striking device. Liquid-type adhesive refers to an adhesive that flows and thereby readily assumes the shape of the regions to which is applied. For example, such an adhesive member may be used to affix the covering element directly to the rear surface of the ball striking plate. Further, such an adhesive member may provide a permanent attachment or a non-permanent attachment of the covering element to the ball striking device.

According to other embodiments, an adhesive member may include a carrier-type adhesive. Certain carrier-type adhesives include single-sided tapes, double-sided tapes, partially-cured films, etc. Many carrier-type adhesives include a backing member, i.e., a thin flexible material to which the adhesive is applied. Many carrier-type adhesives also include a protective film that protects the adhesive during storage and application, but is removed prior to affixation. As an example, any of various suitable double-sided tapes may be used to affix the covering element to the rear surface of the ball striking plate. The use of double-sided tapes may provide a secure attachment, while at the same time simplifying and streamlining the assembling of the covering element to the ball striking device. Further, certain double-sided tapes may transmit shear loads and may be used to viscoelastically dissipate energy and/or dampen undesirable vibrations.

Adhesive members, including epoxies, double-sided tapes, etc. may be provided over the entire area between the opposed surfaces or only over one or more selected regions of the opposed surfaces. For example, a layer of liquid adhesive or a piece of double-sided tape may be provided adjacent to the perimeter of the covering element, but not in a central region. As another example, a first adhesive member may be provided in a first region between the opposed surfaces, a second adhesive member may be provided in a second region between the opposed surfaces, and an unfilled region (i.e., a region without any adhesive member) may separate the first two regions.

Further, the specific selection of any of the various available adhesive members may be used to optimize or improve vibration and/or damping responses of the ball striking plate and/or the ball striking device. For example, placement of a liquid adhesive or a piece of double-sided tape in certain selected regions may allow a designer to specifically tailor the vibration and/or damping characteristics of the ball striking device. As another example, the specific material properties of the adhesive or double-sided tape, such as their viscoelastic properties, density, stiffness, resiliency, etc., may be selected to tailor the vibration and/or damping characteristics of the ball striking device. As a further example, the thickness of the adhesive layer or of the double-sided tapes may be selected to tailor the vibration and/or damping characteristics of the ball striking device.

According to some aspects, the adhesive members may include viscoelastic materials having a relationship between stress and strain that depends on time. In some embodiments, the adhesive members (in conjunction with the covering element) may dissipate mechanical energy and act as a damper. For example, the adhesive member may be formed of a high-loss material having internal hysteresis. Thus, the adhesive members may impact or influence the dynamic response characteristics of the ball striking device. Further, the adhesive members may attenuate acoustic waves. Thus, the adhesive members may impact the sound characteristics of the ball striking device. Even further, the adhesive members may be soft and spongy and easily deformed. Thus, the adhesive member may accommodate the relatively large, dynamic deflections of the ball striking plate that occur when a ball is struck, such that the covering element does not pop off. Still further, the adhesive members may be resilient. Resiliency refers to the ability of the material to return to its undeformed state. In some embodiments, the adhesive members may have an effective stiffness that depends on the rate of application of the load. Thus, the adhesive members may impact the strength characteristics of the ball striking device.

Alternatively, or additionally, other means for affixing the covering element behind the ball striking plate may be employed, including press fits, interference fits, snap fits, thermal fits, mechanical fasteners, including threaded screws and non-threaded pins, clasps, etc. In still other embodiments, the covering element may be formed in place, i.e., by molding (including co-molding and over-molding, casting, etc.).

Certain covering elements may have a constant thickness; others may have a varying thickness (gradually varying, stepped, etc.). In certain embodiments, the covering element may be complexly shaped. For example, the face of the covering element facing the rear surface of the ball striking plate (i.e., the interior face of the covering element) may have a surface topography that complementarily matches the surface topography of the rear surface of the ball striking plate. In the context of this disclosure, the term "topography" refers to the three-dimensional features found on a surface. Thus, the covering element may be configured to fill or partially fill an area surrounding a thickened portion (e.g., a peanut-shaped portion, a kidney-shaped portion, etc.) on the rear surface of the ball striking plate. In some embodiments, the topography of the interior surface of the covering element may generally, but not precisely, complementarily match the topography of the rear surface of the ball striking plate.

In other embodiments, the interior surface of the covering element (i.e., that surface that lies opposed to the rear surface of the ball striking plate) need not complementarily match the topography of the rear surface of the ball striking plate. For example, the rear surface of the ball striking plate may be complexly, topographically shaped, while the opposed, interior surface of the covering element may be flat or relatively flat. One or more gaps, voids, or air spaces may be formed between the two opposing surfaces when the covering element is affixed behind the ball striking plate. It may be desirable to leave these gaps unfilled, if, for example, the deflection of the ball striking plate is to be unrestrained. Optionally, an affixing agent (e.g. an adhesive member) may be used to fill in some or all of the gaps. For example, differing thicknesses of adhesives or of double-sided tape may be provided to fill, or partially fill, gaps of differing thicknesses. Alternatively, a filler separate from the affixing agent may be provided to fill some or all of the gaps. For example, a thin layer of putty or of foam or of another soft, compressible and/or malleable material may be provided between the covering element and the ball striking plate to fill or partially fill any gaps between the covering element and the rear surface of the ball striking plate.

Optionally, the means for affixing the covering element behind the ball striking plate may be selected to essentially isolate the ball striking plate from the covering element, i.e., to minimize any interaction between the ball striking plate and the covering element. Thus, for example, affixing a covering element to the ball striking plate with a relatively soft, relatively thick piece of double-sided tape discontinuously placed only adjacent to the perimeter of the ball striking plate may serve to isolate or decouple the dynamic, flexure, and/or vibrational characteristics of the ball striking plate from the covering element. If, in addition, the covering element is very lightweight and/or very flexible relative to the ball striking plate, the influence on the vibration characteristics of the ball striking device due to affixing a covering element to the ball striking device may be negligible or even substantially non-existent.

In certain example embodiments, the covering elements may be formed of a material having a lesser density than the material used to form the ball striking plate. Further, the material used to form the covering elements may be less dense than the material used to form the majority of the ball striking device. Thus, for example, the ball striking plate may be formed of a high strength stainless steel (or alternatively, a titanium alloy) and the covering element may be formed of an elastomeric material.

In certain other example embodiments, the covering element may be very lightweight, weighing less than or equal to approximately 4.0 gm. Medium weight covering elements may weigh less than approximately 7.0 grams, for example, between approximately 4.0 gm to approximately 7.0 gm. Heavier weight covering elements may weigh less than approximately 12.0 grams, for example, between approximately 7.0 gm to approximately 12.0 gm. According to other embodiments, the covering element may weigh less than 50% of the weight of the ball striking plate. It may be advantageous to have the covering element weigh no more than 40%, 30%, or even 20%. A covering element that weighs no more than 10% of the weight of the ball striking plate may be desirable. A lighter weight covering element may have less of an impact or influence on the flexural behavior of the ball striking plate than would a heavier weight covering element. The covering element may be configured as a lightweight element via the use of low density materials (including foamed materials), and/or by limiting the volume of material (i.e., using thin walled elements).

According to certain aspects, the covering element may be provided as a relatively stiff element when compared to the stiffness of the affixing means. For example, the stiffness of the material used to form the covering element may be a factor of 10 or more stiffer than the material used to form an adhesive layer or a tape layer between the covering element and the ball striking plate. Thus, in certain embodiments the covering element, in conjunction with a viscoelastic affixing means may provide a constrained damping system. As such, the covering element may be used to fine tune the vibrational response characteristics of the ball striking plate and the ball striking device. Certain vibration frequencies, where felt or heard, may be attenuated, thereby improving a user's perception of the ball striking device.

According to some embodiments, the covering element may be relatively thin and/or thin walled. As an example, the covering element may have a maximum wall thickness of approximately 0.030 mm to approximately 1.00 mm. More typically, the covering element may have a wall thickness of approximately 1.00 mm to approximately 2.00 mm. These thicknesses may be especially suitable polymeric covering elements affixed to iron-type golf clubs having metallic ball striking plates.

According to certain embodiments, the covering element may essentially be formed as a plate. As noted above, the thickness of the covering element may be substantially constant. Alternatively, the thickness may vary. For example, the perimeter of the covering element may be thicker than its central region. As another example, certain selected areas of any given covering element may be thinned or thickened.

According to other embodiments, the covering element may be formed as a hollow shell-like structure. A shell-like structure is provided with relatively thin walls that rise up and away from a base plane such that a cavity or void is formed between the thin walls. The base plane is a flat surface (virtual or real) which would support the covering element if the covering element is placed with its interior surface facing the base plane. In some instances, in the context of this disclosure, the base plane may be coincident with the rear surface of the ball striking plate. A shell-like structure may have a height (measured perpendicular to the base plane) that is at least twice the thickness of the relatively thin walls at that measured height. Certain shell-like structures may be provided with internal stiffening elements (i.e., ribs, doublers, etc. extending or placed along the wall surfaces) and/or scaffolding-type elements (i.e., beams, columns, pillars and/or thin-walls extending across the cavity or void to support the shell-like thin walls). The scaffolding-type elements may be provided as a plurality of intersecting thin-wall elements.

Even further, certain covering elements may include both plate-like portions and shell-like portions. Optionally, the covering element may include flanges, knobs, ribs, and other projections, extending from the exterior surface (i.e., that surface of the covering element that is not the interior surface). The exterior surface may also include channels, dimples, depressions and other indentations formed into the exterior surface. These various projections and/or indentations may provide a multi-level external surface topography. Such a multi-level, surface-contoured covering element may include a plurality of abrupt changes in the slope of the surface. Thus, undercuts, step changes and/or substantially vertical slopes may be provided on the exterior surface of the covering element. These surface interruptions may occur in any direction, in multiple directions, may intersect and/or may merge into one another. These surface interruptions may form a plurality of relatively abruptly demarcated surface features. The aggregate of these demarcated surface features may result in very complex surface geometries.

A covering element including surface interruptions and/or demarcated surface features may form a "highly-contoured" topographical exterior surface. For purposes of this disclosure, a "highly-contoured" covering element refers to a covering element having a maximum-to-minimum height ratio of at least 5. Minimum and maximum heights are measured perpendicular to the base plane (i.e., the flat plane upon which the interior surface of the covering element is supported). Thus, for example, a minimum height may be equal 1.0 mm and a maximum height may be greater than or equal to 5.0 mm. For some embodiments, it may be desirable to provide a highly-contoured covering element having a maximum-to-minimum height ratio of at least 8. For other embodiments, a highly-contoured covering element may have a maximum-to-minimum height ratio of at least 10. Highly-contoured covering elements may be formed as solid elements, as shell-like elements, or as a combination of solid and shell-like portions.

In some embodiments, the minimum height of the covering element may be equal to a thickness of a base plate of the covering element. In certain embodiments, wherein a ball striking device cavity is defined by a rearwardly extending frame of the ball striking device, the maximum height may be approximately equal to the net depth of the ball striking device cavity at the top edge of the cavity. Additionally or alternatively, the maximum height may be approximately equal to the net depth of the ball striking device cavity at the lower edge of the cavity. In the context of this disclosure, the "net depth" of a ball striking device cavity refers to the cavity depth minus any adhesive bond line thickness or a double-sided tape thickness or other filler or spacer that spaces the covering element from the rear surface of the ball striking plate. Thus, when a covering element has a maximum height equal to the net depth of the ball striking device cavity, the covering element's maximum height plus any bond line, tape thickness, spacer, etc. will be equal to the cavity depth.

In some embodiments, wherein a ball striking device cavity is defined by a rearwardly extending frame of the ball striking device, a covering element may visually fill the ball striking device cavity or substantially visually fill the cavity. The exterior surface of the covering element may extend completely (or substantially completely) across the ball striking device cavity and, further, the exterior surface of the covering element may lie flush (or substantially flush) with the back surface of the perimeter frame. A covering element that visually fills the ball striking device cavity may be solid or shell-like, as long as the exterior surface of the covering element substantially extends across the opening of the cavity. In other embodiments, a covering element may visually fill greater than 50% of the ball striking device cavity. With the covering element affixed to the ball striking device, the volume above the exterior surface of the covering element may be less than 50% of the volume of the empty ball striking device cavity. In other words, the volume of the covering element (if it were solid) would be greater than 50% of the volume of the empty cavity. In certain embodiments, it may be desirable to have the volume of the covering element (if it were solid) be greater than 60% of the volume of the empty cavity, greater than 70% of the volume of the empty cavity or greater than 80% of the volume of the empty cavity. Thus, in certain embodiments, a relatively lightweight covering element may be positioned within a ball striking device cavity behind the ball striking plate and may visually appear to fill more than 50%, 60%, 70%, 80% or even substantially 100% of the cavity.

As noted above, the covering element may be formed of one or more of a variety of materials, such as polymers, metals (including metal alloys), glasses, ceramics, composites, fiber-reinforced composites, and wood, without departing from the scope of the invention. In one embodiment, the covering elements may be made of polymeric material, including thermosets, thermoplastics, and/or combinations thereof. It is understood that the covering element may be formed of a combination of several different materials.

Additionally, the covering element may be formed by any of various manufacturing methods. For example, covering elements including metals (such as titanium, aluminum, titanium alloys, aluminum alloys, steels (such as stainless steels), and the like) may be formed by forging, molding, casting, stamping, machining, and/or other known techniques. In another example, covering elements formed of composite materials, such as carbon fiber-polymer composites, can be manufactured by a variety of composite processing techniques, such as pre-preg processing, powder-based techniques, mold infiltration, and/or other known techniques. Also, as noted above, if desired, the covering elements may be made from any number of pieces (e.g., having a separate perimeter, upper region, lower layer, etc.) and/or by any construction technique, including, for example, casting, injection molding, compression molding, laminating, 3-D printing, and/or other methods known and used in the art.

Certain covering elements may be formed of a single material; others may be formed from multiple materials. Optionally, certain covering elements may be formed as a single unitarily formed piece; others may be formed as multiple pieces integrally joined together. As would be appreciated by persons of ordinary skill in the art, any of a wide variety of materials may be used to form the covering elements. Further, as would be appreciated by persons of ordinary skill in the art, any of a wide variety of manufacturing methods may be used to form the covering elements.

According to another aspect, the ball striking device may be a golf club having a golf club head and a shaft engaged with the head. Some other specific aspects of this invention may relate to golf clubs, such as drivers, fairway woods, hybrid-type clubs, iron-type golf clubs, and the like, although aspects of this invention also may be practiced on other types of golf clubs or other ball striking devices, if desired. Further aspects may relate to a set of golf clubs, particularly, a set of iron-type clubs, that includes at least one club head according to aspects described above. Although the following description uses golf clubs to exemplify the various aspects of the invention, it is to be understood that the invention is not limited to golf clubs.

Certain, aspects of the present invention relate to structural features for providing ball striking plates with improved performance and durability characteristics. Other aspects of the present invention relate to covering elements positioned behind the ball striking plates. Specific examples of the various aspects are described in more detail below. The reader should understand that these specific examples should not be construed as limiting the invention.

C. Detailed Description of Specific Embodiments

At least some examples of ball striking devices according to this invention relate to golf club head structures, including heads for wood-type golf clubs, including drivers. Such devices may include a one-piece construction or a multiple-piece construction.

FIGS. 1-5 illustrate an embodiment of a ball striking device 10. More particularly, FIGS. 1-5 illustrate a ball striking device 10 generally representative of any iron-type golf club head, in accordance with at least some examples of this invention.

The ball striking device 10 includes a ball striking head 14 and a shaft 12 connected to the ball striking head 14 and extending therefrom. The shaft 12 of ball striking device 10 may be made of various materials such as steel, titanium, graphite, wood, polymers, composite materials, etc., as would be known to persons of skill in the art. A grip (not shown) may be positioned on the shaft 12 to provide a user with a slip resistant surface on which to grasp ball striking device 10.

As shown in FIG. 1-5, the head 14 comprises a body 15 that includes a heel 21 and toe 23, the body 15 extending between the heel 21 and the toe 23. In this particular embodiment, a hosel 22 is provided for connecting the shaft 12 to the head 14. The body 15 also includes a top 24 and a sole 25. A ball striking plate 26 extends between the top 24 and the sole 25 and between the toe 23 and the heel 21.

Figure 2A:
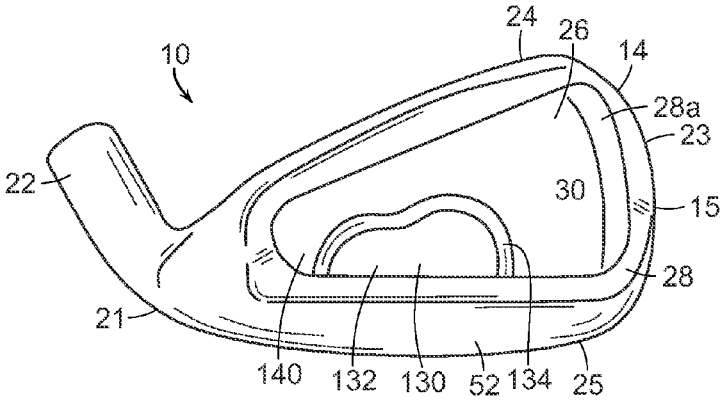
FIG. 2A is a rear view of the head of the ball striking device of FIG. 1.

As best shown in FIG. 2A, the body 15 may include a frame 28 extending at least partially around the perimeter of the striking plate 26. Further, the frame 28 may extend rearwardly from a perimeter of the striking plate 26. In this particular embodiment, frame 28 in conjunction with striking plate 26 has a cup-like configuration, with walls extending rearwardly from the entire perimeter of striking plate 26.

Figure 4:
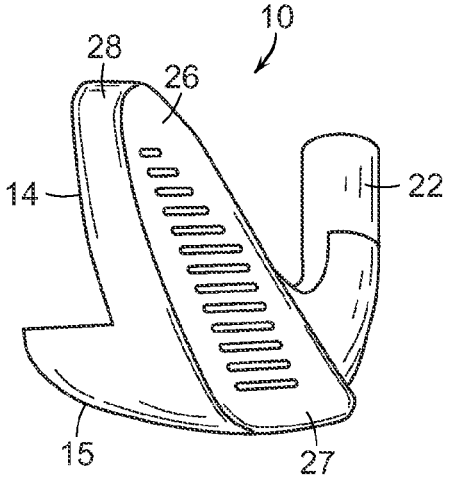
FIG. 4 is a toe-side view of the head of the ball striking device of FIG. 1.

As illustrated in FIGS. 1 and 4, the striking plate 26 includes a front face 27 which provides a contact area for engaging and propelling a golf ball in an intended direction. The front face 27 of the striking plate 26 may include grooves, texturing and/or inserts for optimizing the grip on the ball. Further, the ball striking plate 26 and/or the front face 27 may include some curvature in the top-to-bottom and/or heel-to-toe directions (e.g., bulge and roll characteristics). Even further, the striking plate 26 and/or the front face 27 may be inclined from the vertical (i.e., at a loft angle), to give the ball lift and/or spin when struck. Front face 27 may be provided with any of various bulge, roll, and/or loft characteristics, as are known and conventional in the art.

Further, as illustrated in FIGS. 1-5, the ball striking plate 26 includes a rear or back surface 30 on the side opposite the front face 27. According to certain aspects, one or more thickened portions 130 may extend rearwardly on the rear surface 30 of the ball striking plate 26 and creating one or more raised platforms or elevated areas on the rear surface 30 of the plate. The thickened portion 130 provides increased stiffness to and/or structurally reinforces certain areas or regions of the ball striking plate 26. Examples of ball striking plates, thickened plate portions, and golf club heads and clubs incorporating such are disclosed in U.S. patent application Ser. No. 13/211,961, filed Aug. 17, 2011, titled "Golf Club or Other Ball Striking Device Having Stiffened Face Portion," which is incorporated by reference herein in its entirety.

FIGS. 1-5A illustrate an embodiment of a head 14 with a plate 26 that includes the thickened portion 130 on the rear surface 30 of the plate 26. The thickened portion 130 includes an area that extends behind the geometric center 133 of the ball striking plate 26. Further, the thickened portion 130 may extend at least partially over the desired-contact region of the plate 26 with the ball. In other words, the region of the plate 26 most likely to contact the ball may be provided with a greater thickness than areas more removed from the desired-contact region.

The thickened portion 130 has a greater thickness than the surrounding or peripheral portion 140 of the plate 26. Peripheral portion 140 surrounds (or partially surrounds) the thickened portion 130 and extends from the thickened portion 130 to a perimeter surface 28*a* of the frame 28 (if any). Thickened portion 130 includes an elevated area 132 and may include a transition area 134. According to some aspects and referring to FIG. 5A, the thickened portion 130 may have a maximum thickness ($t_{130}$) of approximately 2.00 mm to approximately 4.50 mm and the peripheral portion 140 may have a maximum thickness ($t_{140}$) of approximately 1.20 mm to approximately 2.50 mm.

Figure 3:
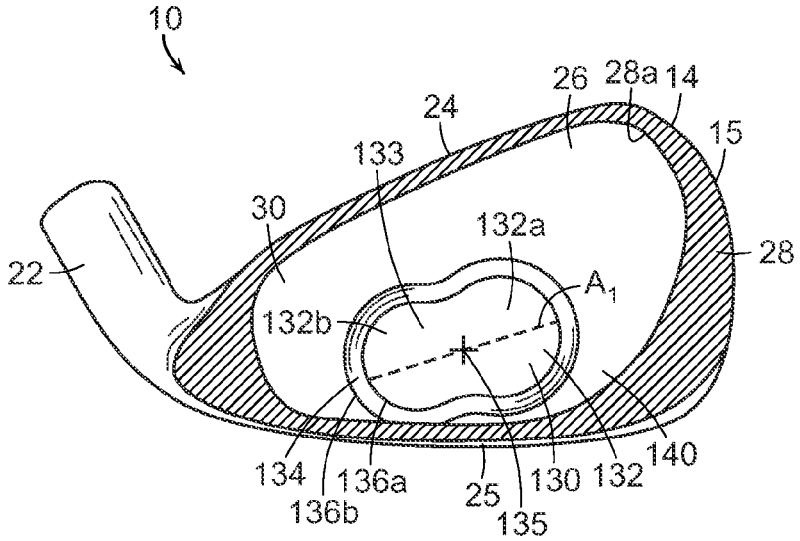
FIG. 3 is a rear view of the head of the ball striking device of FIG. 1 with a portion of a frame of the head cut away to better view the rear surface of the ball striking plate.

According to certain aspects, the thickened portion 130 may have any of various different shapes and configurations. For example, as best shown in FIG. 3, the thickened portion 130 of the plate 26 may have a generally peanut shape—two generally rounded lobes of equal (or unequal) size connected by a necked-down connector region. As shown, thickened portion 130 may include a first elevated area 132 bounded by contour edge 136*a*. In general, the elevated area 132 may have any suitable shape, including a peanut-type shape, a kidney-type shape, an amoeba-type shape (i.e., amorphous with curves), elliptical, round, a pear-type shape, oblate, square, hexagonal, star-shaped, etc.

According to some aspects, and as best shown in FIG. 3, the upper contour edge 136*a* of the ball striking plate 26 may define a double-lobed shape. Such a shape may be referred to as a "peanut" shape. Thus, the elevated level 132 may include a first lobe 132*a*, a second lobe 132*b*, and a connecting portion 132*c* extending between the lobes 132*a*, 132*b*. The connecting portion 132*c* is necked down (i.e. it has a smaller width than the lobes 132*a*, 132*b* on either side) such that it defines a waist. Typically, the first and second lobes 132*a*, 132*b* may be provided with convex contour edges and the connecting portion 132*c* may be provided with a concave contour edges. As shown in FIG. 3, the upper contour edge 136*a* may smoothly (i.e., without abrupt changes in contour shape) extend around the elevated level 132.

In certain embodiments, the elevated level 132 may be formed as a plateau (i.e., a generally flat, non-inclined region) having generally constant thickness. Alternatively, the surface of the elevated level 132 may be formed with a tapered shape, a domed shape, a bowl shape, a saddle shape, a rippled shape, and/or combinations thereof, or other varying height surface. In other words, the thickness of the elevated level 132 may vary within its contour edge 136*a*.

According to some aspects, an annular transition area 134 may surround the elevated area 132 and extend between an upper contour edge 136*a* and a lower contour edge 136*b*. The thickness of the transition area 134 may gradually decrease or otherwise vary as it transitions from the upper contour edge 136*a* to the lower contour edge 136*b*.

The lower contour edge 136*b* of transition area 134 may generally follow the contour of the upper contour edge 136*a*. Thus, if the upper contour edge 136*a* follows a double-lobed shape, the lower contour edge 136*a* may also follow a double-lobed shape. Optionally, the shape of the lower contour edge 136*b* may deviate from the shape of the upper contour edge 136*a*. Thus, for example, the upper contour edge 136*a* may be peanut shaped, while the lower contour edge 136*b* may be kidney shaped, amoeba shaped, elliptical, round, pear shaped, etc.

Additionally, as shown in FIG. 3, an axis of elongation ($A_1$) is defined along the maximum dimension of the thickened portion 130. The axis of elongation ($A_1$) generally extends along the line of the two lobes 132*a*, 132*b*. Lobes 132*a*, 132*b* may each have dimensions measured along a second axis perpendicular to the axis of elongation ($A_1$) which are greater than the dimensions perpendicular to the axis of elongation in the connecting area 132*c*.

As shown in the embodiment of FIG. 3, the thickened portion 130 may be more proximate the bottom edge 25 of the ball striking plate 26 than the top edge 24. By way of example, the center of the thickened portion 130 may be approximately 15-22 mm from the bottom edge 25. This distance may be different in other embodiments.

Figure 2B:
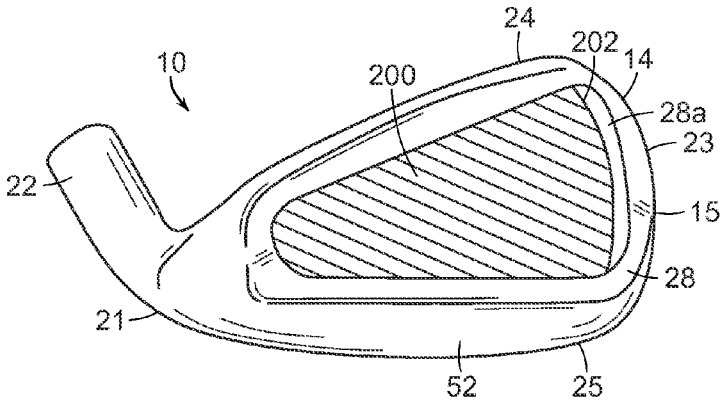
FIG. 2B is a rear view similar to FIG. 2A, with the addition of a covering element located behind the ball striking plate according to aspects of the invention.

Referring back to FIG. 2B, a covering element 200 may be affixed to body 15. In this particular embodiment, covering element 200 lies nestled within the cup-like configuration of frame 28. Thus, it can be seen that the perimeter 202 of covering element 200 may complementarily match the interior perimeter surface 28*a* of frame 28. Further, it can be seen the covering element 200 may extend over the entire rear surface 30 (not shown in FIG. 2B) of the ball striking plate 26. Additionally, according to certain aspects, the covering element 200 may be elastically flexible so that it may be deformed during placement behind the ball striking plate 26. In the embodiment of FIG. 2B, it is expected that covering element 200 would be flexed during its insertion into frame 28.

Figure 2C:
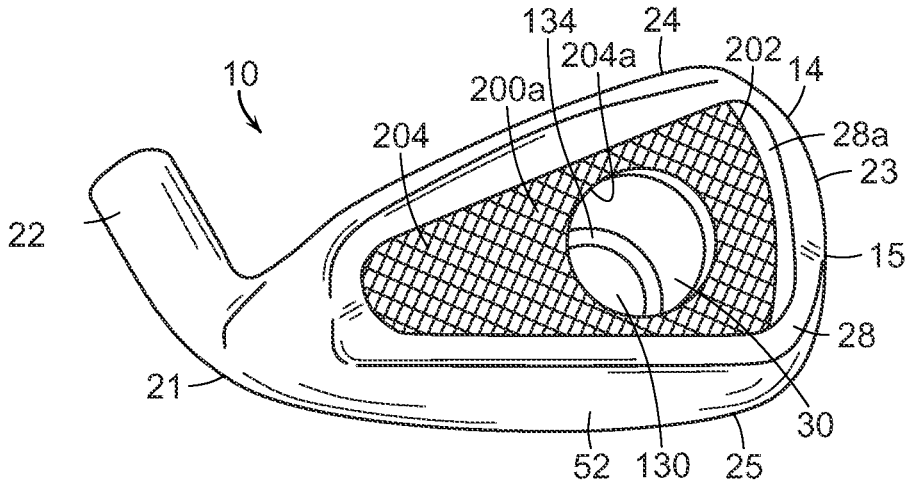
FIG. 2C is a rear view similar to FIG. 2A, with the addition of a covering element located behind the ball striking plate according to other aspects of the invention.

According to another embodiment as shown in FIG. 2C, a first covering element 200*a* may extend only over a portion of the rear surface 30 of the striking plate 26. For example, covering element 200*a* may be formed as a frame-like element 204 that extends around the entire interior perimeter surface 28*a* of frame 28, but which defines an opening 204*a*. The rear surface 30 of striking plate 26 may be accessed or viewed through opening 204*a*.

Opening 204*a* may be of any size or shape. Further, any given opening need not be completely surrounded by a frame-like element. For example, the opening may be provided as a cut-out along one edge of the covering element. Optionally, more than one opening may be provided in a covering element.

Figure 2D:
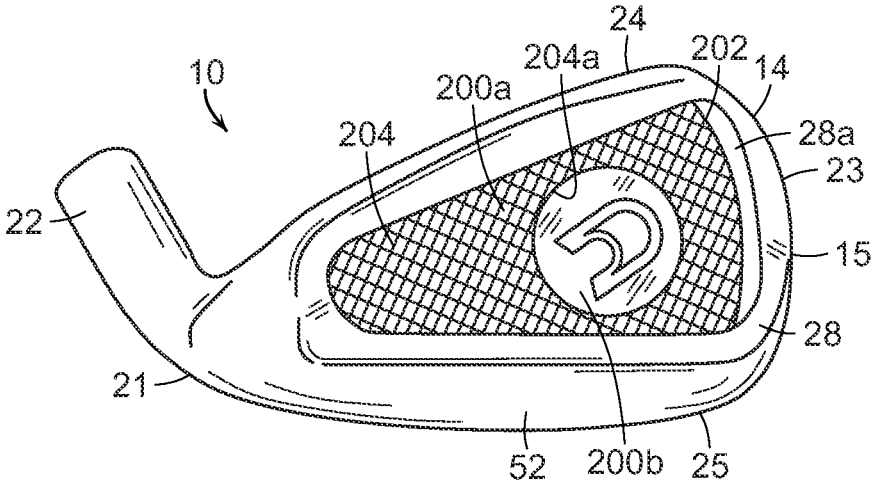
FIG. 2D is a rear view similar to FIG. 2A, with the addition of a covering element located behind the ball striking plate according to further aspects of the invention.

As shown in FIG. 2D, a second covering element 200*b* may be inserted into the opening 204*a* of first covering element 200*a*. The second covering element 200*b* may be affixed to the first covering element 200*a*, to the rear surface 30 of the ball striking plate 26 and/or to both. Thus, it is shown that a plurality of covering elements 200 may be affixed behind the ball striking plate 26.

In FIG. 2D, the covering elements 200*a*, 200*b* may be formed of the same or different materials. Further, as shown, the exterior surface of covering element 200*b* may be provide with topographical features, for example, an embossed surface, while the exterior surface of covering element 200*a* may be substantially featureless or flat. Further, the exterior surface of covering element 200*b* may be provided with a highly reflective coating, while the exterior surface of covering element 200*a* may be provided with a matte-type finish. A person of ordinary skill in the art, given the benefit of this disclosure, would appreciate that any of many different surface finishes, textures, topographies, colors, opacities, etc. may be provided with the covering elements 200. Although not shown, any individual covering element 200 may be provided with an inset item, whether decorative or functional.

Figure 5A:
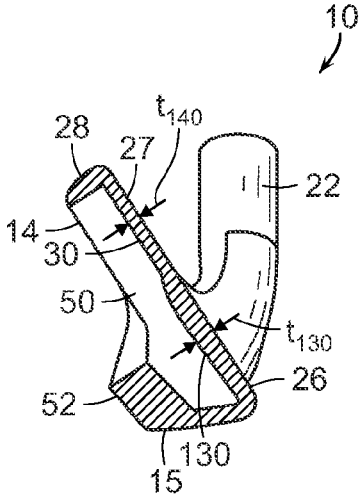
FIG. 5A is a cross-section view taken along line 5A-5A of the head of the ball striking device of FIG. 1.
Figure 5B:
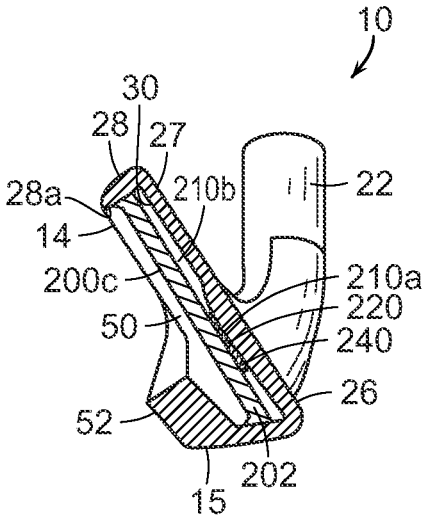
FIG. 5B is a cross-section view similar to FIG. 5A, with the addition of a covering element located behind the ball striking plate.

In an embodiment as shown in FIG. 5B, a covering element 200*c* may extend from an interior top edge of the frame perimeter 28*a* to an interior sole edge of the frame perimeter 28*a*. In this particular embodiment, covering element 200*c* has a substantially flat or planar exterior surface and a substantially flat or planar interior surface. Although shown in this figure as having a constant thickness, in general, the thickness of any given covering element 200 may vary. Because, in this specific embodiment, rear surface 30 of ball striking plate 26 is contoured, as discussed above, and the interior surface of covering element 200*c* is substantially flat, the opposed surfaces are not complementarily matched and gap regions 210*a*, 210*b* having different thicknesses are formed therebetween (gap region 210*a* being thinner than gap region 210*b* in this particular embodiment). According to certain embodiments and as shown in FIG. 5B, one or more of these gap regions between the opposed, facing surfaces may be left unfilled. Gap region 210*b* is unfilled.

Covering element 200 may be affixed to the ball striking device 10 via any suitable means. It may be particularly advantageous to affix covering element 200 to the ball striking device 10 using an adhesive member 220, as discussed above. For example, as shown in FIG. 5B, a portion of covering element 200*c* is attached to a portion of the rear surface 30 of striking plate 26 by means of an adhesive member 220 such as double-sided tape 240. In this particular embodiment, double-sided tape 240 is provided at gap region 210*a* where the gap thickness is a minimum. A suitable double-sided tape may be a high-strength double-sided bonding tape manufactured by 3M™. For example, the 3M™ VHB™ line of closed-cell, acrylic-foam double-sided tapes, which are designed for permanent assembly, with no drying time, may be particularly advantageous. Other suitable double-sided tapes may be used, as would be apparent to persons of ordinary skill in the art given the benefit of this disclosure.

Double-sided tapes may continuously distribute loads over the entire areas of the bond joints, while also providing advantageous shock or impact absorption capabilities. Using double-sided tapes may provide further advantages including environmental sealing capabilities, compensating for slight surface irregularities or mismatches, and/or facilitating assembly. For example, double-sided tapes may be precision die-cut to fit the various shapes of the covering elements or the desired bonding footprints. A variety of tape thicknesses (including thicknesses of 0.016 in. (0.4 mm), 0.025 in. (0.6 mm), 0.032 in. (0.8 mm), 0.045 in. (1.1 mm) and 0.062 in. (1.55 mm)) may be available to accommodate various gap thicknesses.

Figure 5C:
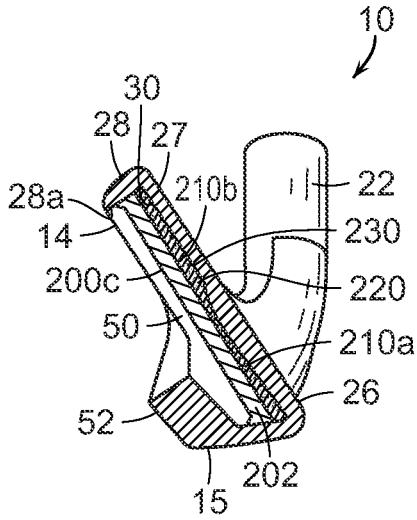
FIG. 5C is a cross-section view similar to FIG. 5A, with the addition of a covering element located behind the ball striking plate according to another embodiment.

Optionally, as shown in FIG. 5C, the entire region between the opposed surfaces of the ball striking plate 26 and covering element 200*c* may be provided with an adhesive member 220. For example, a liquid-adhesive 230 of a suitable thickness to fill the entire gap may be applied. Thus, adhesive member 220 may be provided both in thinner gap region 210*a* and in thicker gap region 210*b*.

Figure 5D:
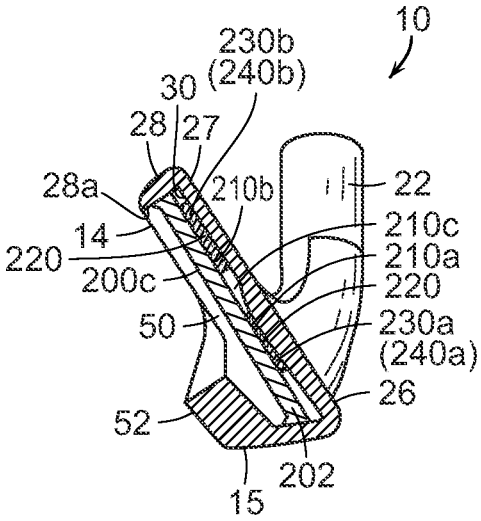
FIG. 5D is a cross-section view similar to FIG. 5A, with the addition of a covering element located behind the ball striking plate according to even another embodiment.

As shown in FIG. 5D, in certain embodiments, an adhesive member 220, such as adhesive 230, may be provided only in select areas of the region between the opposed surfaces of covering element 200*c* and ball striking plate 26, and unfilled regions (i.e., regions without any adhesive member) may separate regions where the adhesive is present. Thus, adhesive 230 may be provided in a first gap region 210*a* and also in a second gap region 210*b* with a region 210*c* having no adhesive located therebetween. The adhesive 230 may be the same formulation, or alternatively, a first adhesive formulation may be provided in gap region 210*a* and a second adhesive formulation may be provided in gap region 210*b*. The adhesive formulations may be selected based on flow properties, curing parameters and/or cured properties. For example, the adhesive provided in the thinner gap region 210*a* may be less stiff, i.e., softer and more elastically deformable, than the adhesive provided in the thicker gap region 210*b*.

Alternatively, a first piece of double-sided tape 240*a* may be provided in a first region 210*a* between the opposed surfaces (as alternatively shown in FIG. 5B) and a second piece of double-sided tape 240*b* may be provided in a second region 210*b* between the opposed surfaces. As shown in FIG. 5D, the first and second regions 210*a*, 210*b* may have different thicknesses. Thus, it may be desirable to have a first double-sided tape 340*a* having a first thickness in the first region 210*a* and a second double-sided tape 240*b* having a second thickness in the second region 201*b*. The first and second double-sided tapes 240*a*, 240*b* may abut one another or, alternatively, an unfilled region or space, for example at region 210*c*, may be provided therebetween. In such instance, region 210*c* will be devoid of an adhesive member 220 (e.g., double-sided tape 240). Region 210*c* provides a transition between the first thickness of region 210*a* and the second thickness of region 210*b*, and as such, region 210*c* may have a varying gap thickness.

Figure 5E:
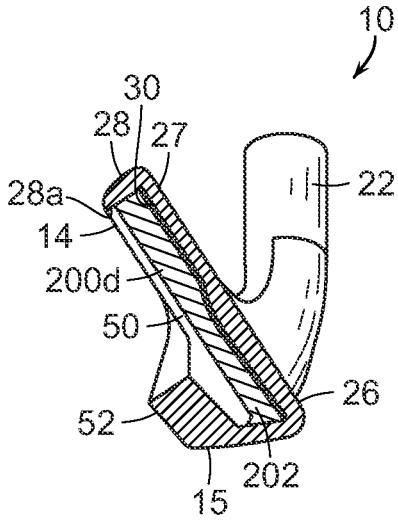
FIG. 5E is a cross-section view similar to FIG. 5A, with the addition of an alternative embodiment of a covering element located behind the ball striking plate according to a further embodiment.

As shown in FIG. 5E, a covering element 200*d* may extend from an interior top edge of the frame perimeter 28*a* to an interior sole edge of the frame perimeter 28*a*. In this particular embodiment, covering element 200*d* has a substantially flat or planar exterior surface and a contoured interior surface. The contoured interior surface complementarily matches the contoured rear surface 30 of striking plate 26. Covering element 200*d* may be affixed to frame 28 via adhesives, double-sided tape, press fit, interference fit, snap fit, threaded fasteners, etc. Alternatively, or additionally, covering element 200*d* may be affixed to the rear surface 30 of ball striking plate 26 via adhesives, double-sided tapes, threaded fasteners, etc. A person of ordinary skill in the art, given the benefit of this disclosure, would understand that any single method of suitable attachment may be used or that one or more methods of suitable attachment may be used in combination.

Thus, according to some embodiments and referring back to FIGS. 1-5A, the ball striking plate 26 may be located at the front of a golf club head 14. The head 14 may further include a rear cavity 50 that is at least partially bounded by the rear surface 30 of the striking plate 26 and the frame 28. Further, a rear wall 52 may extend upward from the lower edge of the frame 28 at the rear of the head 14, such that rear wall 52 defines at least a partial back wall of the rear cavity 50. It is to be understood that in other embodiments the rear cavity 50 may be open to a greater or lesser degree. For example, the rear wall may be partial and/or discontinuous. Even further, in some embodiments, rear cavity 50 may be formed without any rear wall.

Indeed, in general, the rear surface 30 of the ball striking plate 26 need not be bounded by a frame 28 or may be bounded by a partial frame. For example, a frame 28 may extend along the sole edge of the ball striking plate 26, but not along the top edge. As another example, a frame 28 may be formed along the heel side and/or along the toe side of the ball striking plate 26. The frame, if any, may be continuous and/or discontinuous.

Figure 6A:
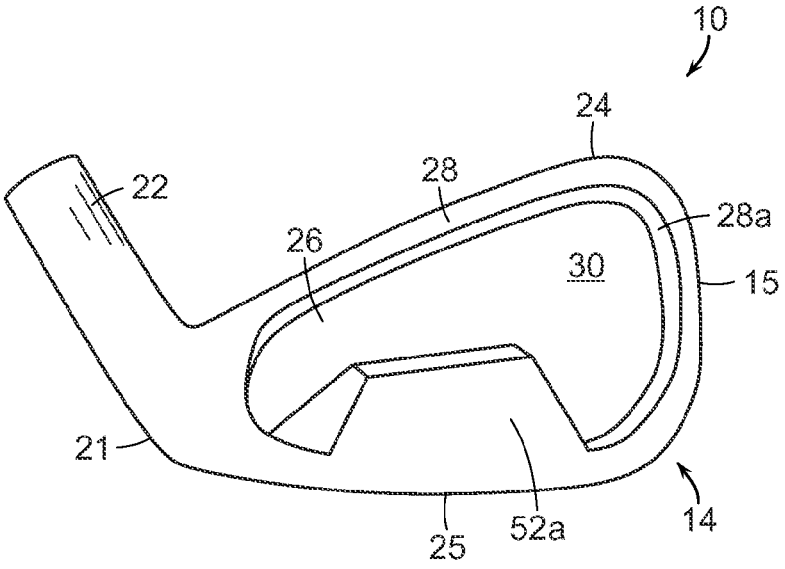
FIG. 6A is a rear view of a head of a ball striking device according to another embodiment.
Figure 6B:
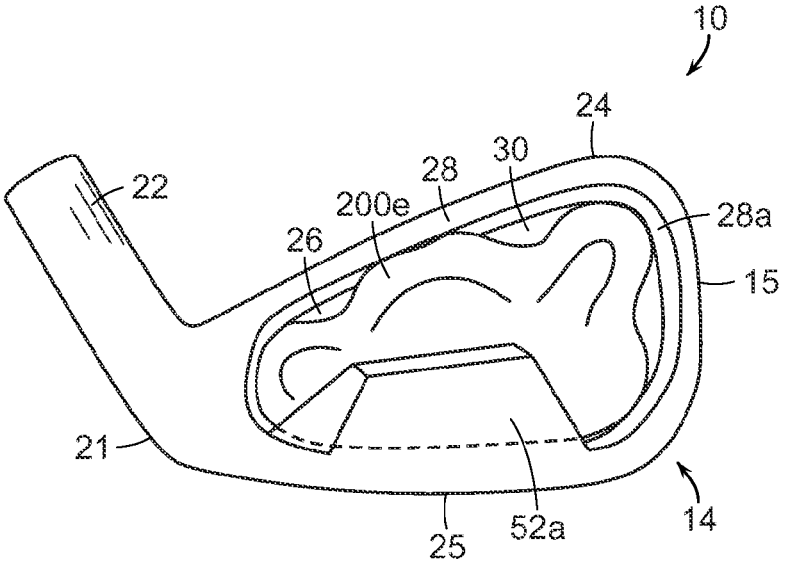
FIG. 6B is a rear view of the club head of FIG. 6A, with the addition of a covering element located behind the ball striking plate according to a further embodiment.

For example, in the embodiments shown in FIGS. 6A and 6B, a ball striking device 10 may include a rear cavity 50 that is bounded by frame 28. The front-to-rear depth of rear cavity 50 may be constant or it may vary. As one example, the front-to-rear depth of rear cavity 50 may increase as the cavity extends from top to bottom. Alternatively, or additionally, the front-to-rear depth of rear cavity 50 may increase as the cavity extends from the heel 21 to the toe 15. As one option, the frame 28 may have a substantially constant front-to-rear depth along its top edge as tends from heel to toe, while along the toe edge, the front-to-rear depth of the frame 28 may increase as the frame extends from heel to toe. An inner perimeter surface 28*a* of frame 28 extends around the perimeter of the rear surface 30 of ball striking plate 26.

As shown in FIG. 6A, a rear wall portion 52*a* may project upward and extend along a central portion of the lower edge of frame 28. According to some embodiments, the thicknesses of the central rear wall portion 52*a* may vary. For example, the thickness of rear wall portion 52*a* may be greater at its lower edge as compared to their upper edge. According to other embodiments (not shown), the thickness of the rear wall 52 may be substantially constant.

As shown in FIG. 6A, the rear surface 30 of the ball striking plate 26 may be formed as a substantially flat plate. Alternatively, rear surface 30 may include the thickened portions 130 as described above, and/or other contoured portions of the ball striking plate 26. In general, rear surface 30 may include any surface geometry (i.e., topography).

As shown in FIG. 6B, a covering element 200*e* may be located within cavity 50, between rear surface 30 of striking plate 26 and the interior wall surface of central rear wall portion 52. Covering element may fill the entirety of cavity 50, or as shown by covering element 200*e* in FIG. 6B, may fill only a portion of the cavity. (A dashed line in FIG. 6B show the contour of covering element 200*e* where it extends behind the central rear wall portion 52*a*, when the ball striking device is viewed from the rear.) In this particular embodiment, portions of covering element 200*e* extend to the inner perimeter surface 28*a* of frame 28. In other areas, covering element 200*e* is spaced from the inner perimeter surface 28*a*.

In the embodiment shown in FIGS. 7A-7I, a ball striking device 10 may include a rear cavity 50 with a rear wall 52 that is formed by corner portions 54. A first corner portion 54*a* may be located in a lower heel quadrant of the club head; a second corner portion 54*b* may be located in a lower toe quadrant of the club head 14. According to some embodiments, the thicknesses of the corner portions 54 may vary. For example, the thickness of corner portions 54 may be greater at their lower edges as compared to their upper edge. According to other embodiments (not shown), the thickness of the corner portions 54 may be substantially constant.

Figure 7A:
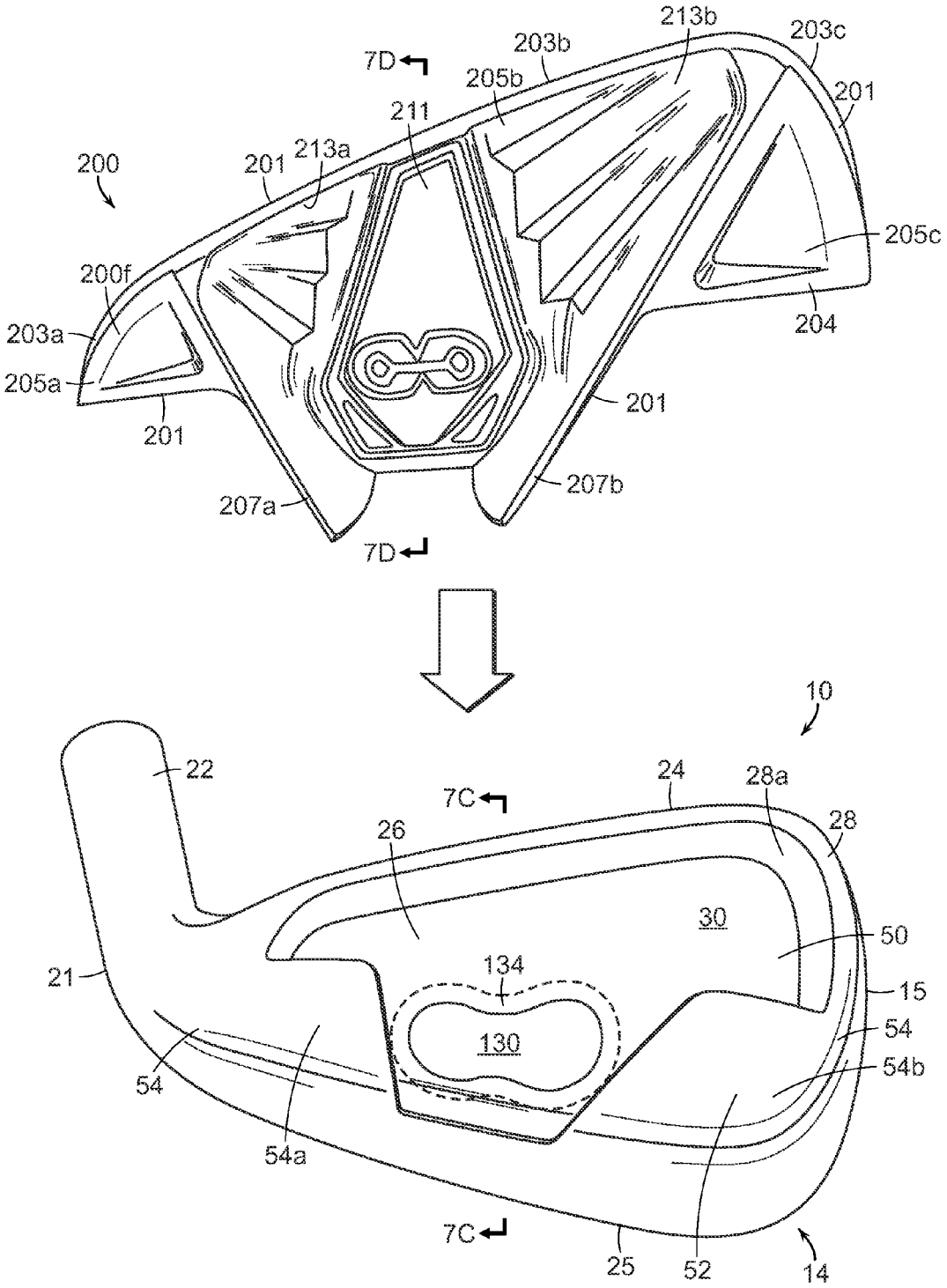
FIG. 7A is an exploded perspective rear view of a head of a ball striking device, illustrating a club head and a covering element, according to even another embodiment.
Figure 7B:
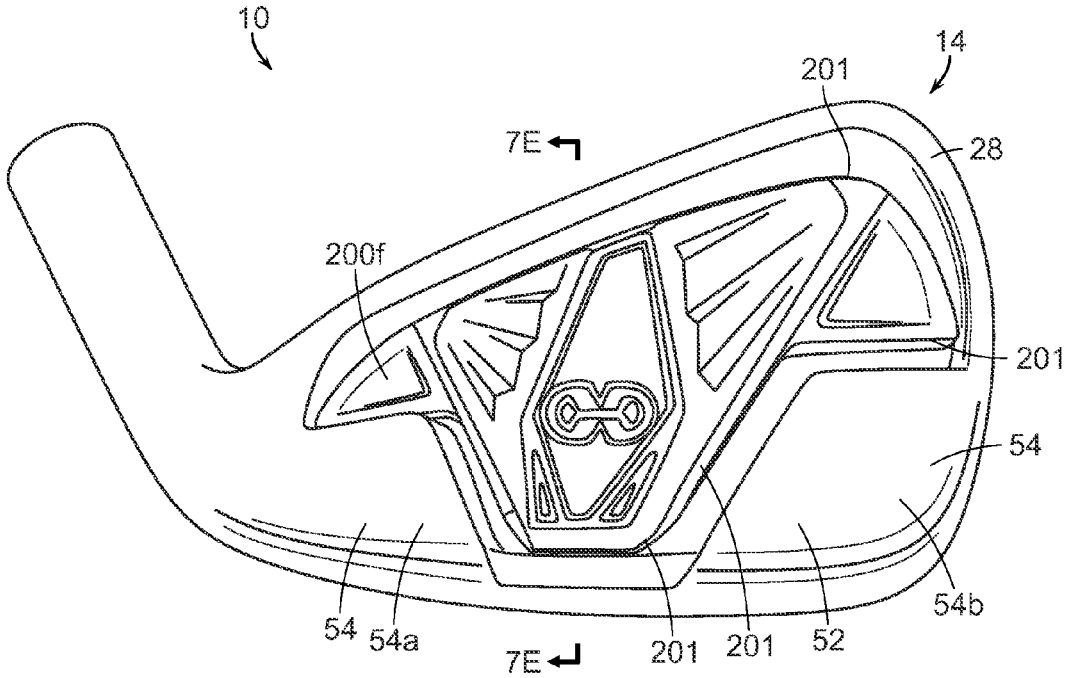
FIG. 7B is a perspective rear view of the head of the ball striking device of FIG. 7A, with the covering element illustrated in place behind the ball striking plate.
Figure 7C:
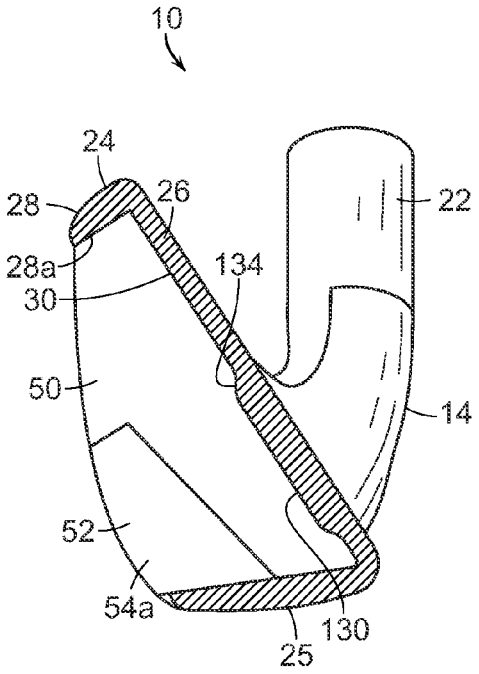
FIG. 7C is a schematic cross-sectional view taken through 7C-7C of FIG. 7A.

As shown in FIGS. 7A and 7C, ball striking plate 26 may include a thickened portion 130, as discussed above. This thickened portion may be substantially peanut-shaped. Other shapes for the thickened portion include kidney-shaped, oval, circular, tri-lobed, and other shapes with gently and smoothly curved perimeters. This thickened portion 130 is provided as an elevated area on the rear surface 30 of the ball striking plate 26. A transition area 134 having a varying thickness surrounds thickened portion 130. In general, rear surface 30 may include any surface geometry (i.e., topography).

As further shown in FIGS. 7A and 7B, a covering element 200 may be configured for placement or insertion into cavity 50. Specifically, as shown in FIG. 7B, covering element 200*f* may be located within cavity 50, between rear surface 30 of striking plate 26 and the interior wall surfaces of corner portions 54*a*, 54*b*. In this particular embodiment, covering element 200*f* substantially extends to (i.e., to at least just adjacent to) the inner perimeter surface 28*a* of frame 28. A gap or space may be provided between the frame 28 and the perimeter edges of covering element 200*f* to take into account manufacturing tolerances.

In this embodiment, the perimeter 201 of covering element 200*f* complementarily follows the inner surface curvature of frame 28 along the top edge and along an upper portion of the toe edge. Further, covering element 200*f* includes a lower edge that complementarily extends along the walls of the corner portions 54*a*, 54*b*. In between these corner portions, the perimeter 201 of covering element 200*f* complementarily follows the profile of the bottom edge of frame 28. Thus, when viewed from the back of the ball striking device 10, covering element 200*f* extends across the opening of the cavity 50, side-to-side and top-to-bottom.

Figure 7D:
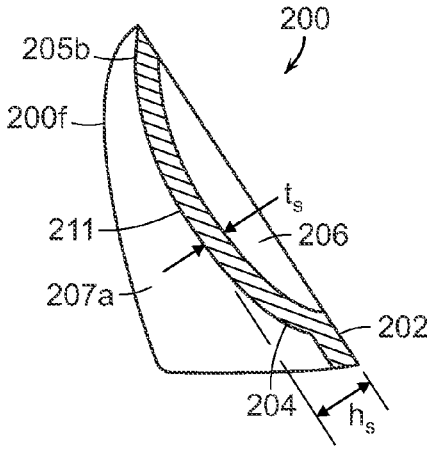
FIG. 7D is a schematic cross-sectional view taken through 7D-7D of the covering element of FIG. 7A, with structure within interior of cavity removed for clarity.
Figure 7E:
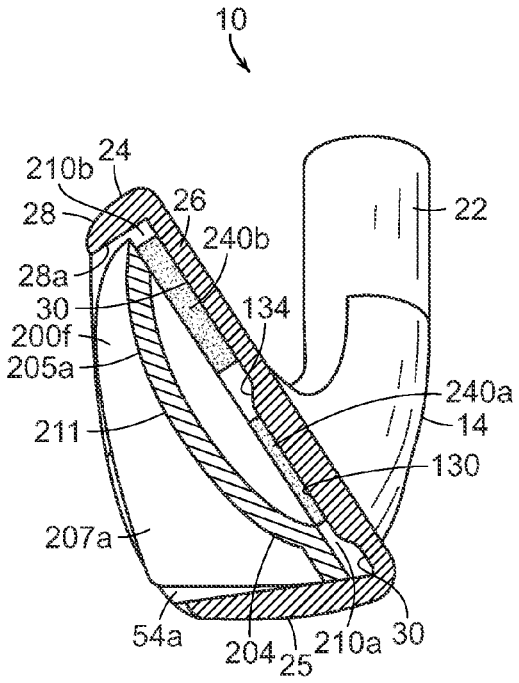
FIG. 7E is a schematic cross-sectional view taken through 7E-7E of FIG. 7B.
Figure 7F:
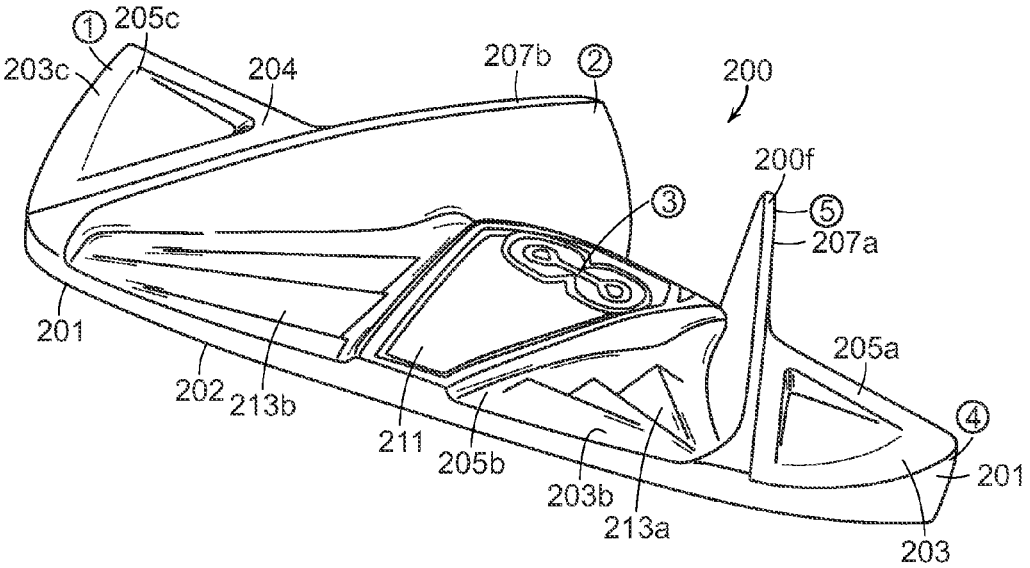
FIG. 7F is a perspective top view of the covering element of FIG. 7A.
Figure 7G:
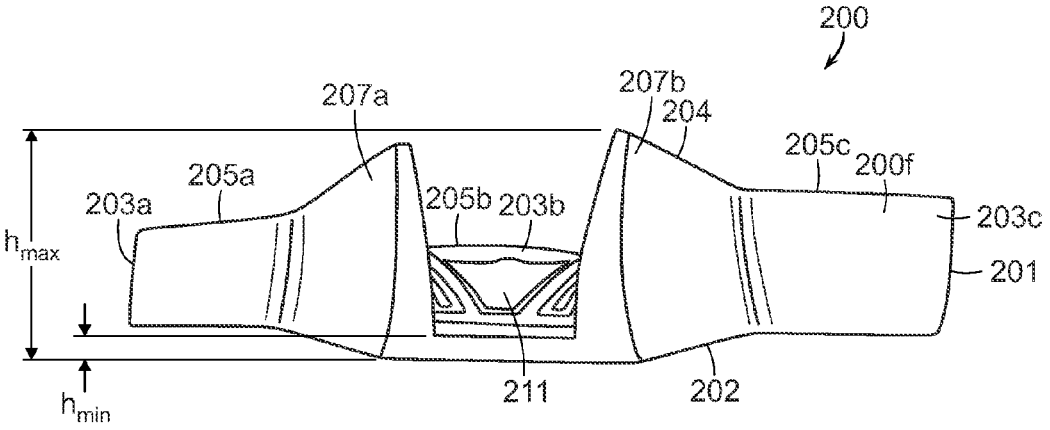
FIG. 7G is a perspective bottom view of the covering element of FIG. 7A with double-sided tape in place.

Referring also to FIGS. 7F and 7G, it can be seen that covering element 200*f* includes an interior surface 202 and an exterior surface 204. The interior surface 202 is that surface facing the rear surface 30 of ball striking plate 26; the exterior surface 204 is that surface facing away from the interior of the cavity and visible when the back of the ball striking device 10 is viewed. In this particular embodiment, the interior surface 202 presents a planar surface when viewed edge-on (see e.g. FIG. 7I).

Figure 7H:
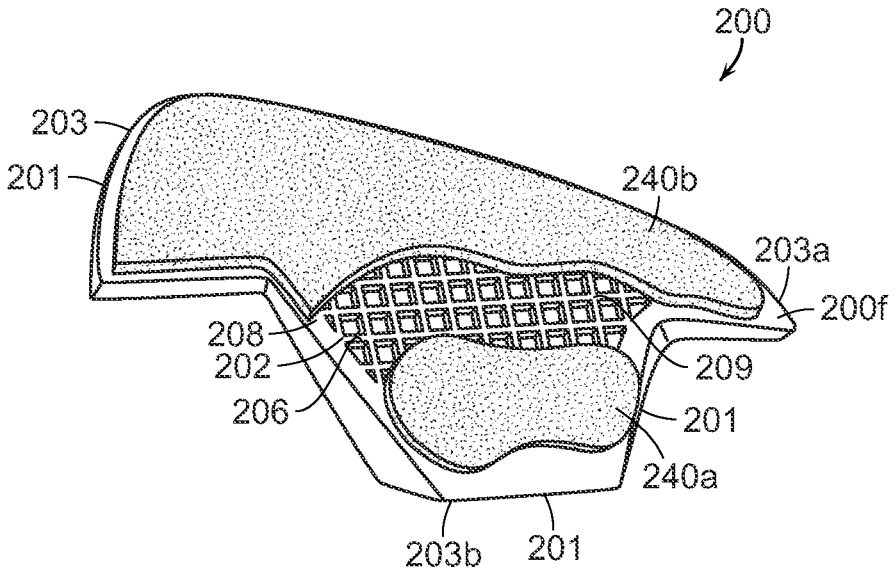
FIG. 7H is a perspective back view of the covering element of FIG. 7A with double-sided tape in place.

Further, referring now to FIGS. 7D, 7E and 7H, it is shown that covering element 200*f* may be formed as a relatively thin-walled shell-like element. Specifically referring to FIG. 7H, within the cavity 206 formed by walls 208, a gridded scaffolding structure 209 may be provided. Scaffolding structure 209 may be formed as a plurality of intersecting thin plate elements. Scaffolding structure 209 may strengthen and/or stiffen the walls 208 of covering element 200*f*. In another example embodiment (not shown), a scaffolding structure may be provided as a series of parallel thin-walled plates or as groups of parallel thin-walled plates. Further, scaffolding structure 209 may provide a surface for mounting, retaining, constraining, etc. an affixing means such as an adhesive 230 (not shown) or a double-sided tape 240. In certain embodiments (not shown), cavity 206 may be filled or partially filled with a foamed polymer. In other embodiments (not shown), cavity 206 may be an open cavity, i.e., devoid of scaffolding or fill material. In even other embodiments (not shown), covering element 200 may be provided as a shell-like element, wherein the opening of cavity 206 is closed off with a plate, sheet, film, etc. In even other embodiments, the covering element may be a solid element.

Referring to FIG. 7D, when formed as a thin-walled shell-like element, covering element 200*f* may have a thin-wall thickness ($t_s$) that is significantly less than the height ($h_s$) of the shell-like element measured at the same location. As disclosed above, a shell-like structure is provided with relatively thin walls that rise up and away from a base plane such that a cavity or void is formed by the thin walls. The base plane is a flat surface (virtual or real) which would support the covering element if the covering element is placed with its interior surface facing the base plane. Table I provides some representative shell thicknesses and shell heights for the covering element 200*f*. Locations 1 through 5 are identified in FIG. 7F (see circled item numbers 1-5). In general, a shell-like structure may have a shell height (measured perpendicular to the base plane) that is at least twice the thickness of the relatively thin walls at that measured height. The ratio of shell height-to-shell wall thickness may be greater than 4, greater than 8, greater than 13, or even greater than 18.

TABLE I

Representative Shell Heights and Shell Wall Thicknesses

| Location | Height | Thickness |
|---|---|---|
| 1 | 15.12 mm | .80 mm |
| 2 | 10.14 mm | 2.27 mm |
| 3 | 7.67 mm | .86 mm |
| 4 | 6.54 mm | 2.28 mm |
| 5 | 13.27 mm | .98 mm |

According to certain embodiments and as shown in FIGS. 7A, 7B, 7F and 7G, the exterior surface 204 of covering element 204 may be a highly-contoured structure, i.e., a structure having a maximum-to-minimum height ratio of at least 5. For illustrative purposes, a representative minimum height ($h_{MIN}$) and a representative maximum height ($h_{MAX}$) are shown in FIG. 7G. These minimum and maximum heights are measured perpendicular to the base plane, which in this embodiment is coincident with the interior surface 202.

Further, it can be seen that the exterior surface of covering element 200*f* may include multiple indentations, recesses, channels and carve-outs, etc., multiple projections, protuberances, bulges, flanges, and ridges, etc. and/or complexly-curved areas. For example, referring to FIG. 7A and also to FIGS. 7F and 7G, in this particular embodiment of covering element 200*f*, a heel-side portion 203*a* extends from a center "flanged" or winged" portion 203*b*. A toe-side portion 203*c* extends from the opposite side of the center "winged" portion 203*b*. Toe-side portion 203*a* is smaller than heel-side portion 203*c*. Heel-side portion 203*a* has a thickness that increases as it extends from the top edge towards the bottom edge of the ball striking plate 26. Further, the exterior surface 205*a* of heel-side portion 203*a* has a relatively shallow V-shaped indentation that is deepest its vertex and smoothly merges with the remainder of the exterior surface 205*a* at the indentation's base. Similarly, toe-side portion 203*c* also has a thickness that increases as it extends from the top edge towards the bottom edge of the ball striking plate 26. The exterior surface 205*c* of toe-side portion 203*c* is also provided with a relatively shallow V-shaped indentation that is deepest its vertex and which smoothly merges with the remainder of the exterior surface 205*c* at the indentation's base. Center portion 203*b* includes a rising flange or wing 207*a*, 207*b* extending from the top edge to the bottom edge of covering element. These flanges 207*a*, 207*b* rise dramatically from the floor of the exterior surface 205*b* in the center portion 203*b*. Between the flanges 207*a*, 207*b*, the exterior surface 205*a* includes a convexly-curved, slightly-elevated portion 211 substantially extending from the top edge to the bottom edge of the covering element 200*f* and first and second sets of triangular rays 213*a*, 213*b* radiating from the junctions of the wings 207*a*, 207*b* with the top edge of the covering element 200*f* toward the slightly-elevated convexly-curved portion 211. The topographically-complex exterior surface 205*b* of the central portion 203*b* between the wings 207*a*, 207*b* generally lies below the somewhat simpler exterior surfaces 205*a*, 205*c* of the heel-side and toe-side portions 203*a*, 203*c*.

Thus, as illustrated in FIGS. 7A-7I, covering element 200*f* is a highly-contoured, topographically-complex element. Such a highly-contoured covering element may be injection-molded. Further, the contours and the complexity of the geometry of the exterior surface 204 is emphasized by the surface finishes and colors applied to the covering element 200*f*. For example, a metallic-type nanocoating may be applied to provide a covering element that resembles a metal fitting.

Referring back to FIGS. 7H and 7I and also now to FIG. 7E, it can be seen that the interior surface 202 of covering element 200*f* is generally planar. First and second pieces of double-sided tape 240*a*, 240*b* are shown affixing covering element 200*f* to the ball striking device 10. As noted above, any of various suitable double-sided tapes 240 may be used to affix a covering element 200 to the rear surface 30 of the ball striking plate 26. Depending upon the characteristics of the double-sided tape, the vibrational response characteristics of the ball striking plate 26 and/or of the ball striking device 10 may be modified such that a user of the ball striking device 10 may perceive the change. Further, the use of double-sided tapes may be particularly advantageous (as compared to adhesives) due to their ease of handling, applying/assembling and negligible or nonexistent cure time.

As best shown in FIG. 7E, a first piece of double-sided tape 240*a* may be positioned between the thickened portion 130 of the ball striking plate 26 and a second piece of double-sided tape 240*b* may be provided in regions of the ball striking plate that are remote from the thickened portion. The region of the rear surface 30 having a transition area 134 may be devoid of tape (i.e., tapeless). As best shown in FIG. 7H, the first piece of double-sided tape 240*a* may have the same, generally, peanut-shaped profile as the thickened portion 130. The second piece of double-sided tape 240*b* may generally extend over the remainder of the interior surface 202 of covering element 200*f*, which the exception of the region where transition area 134 is defined. The specific location of the double-sided tape and the area covered by the double-sided tape may be used to tailor the dynamic response of the ball striking plate 26. Further, it is expected that providing a piece of tape directly behind the areas of highest stresses or greatest deflections (for example, directly behind the expected point of impact of the ball striking plate with the ball) will result in the greatest effect.

Figure 7I:
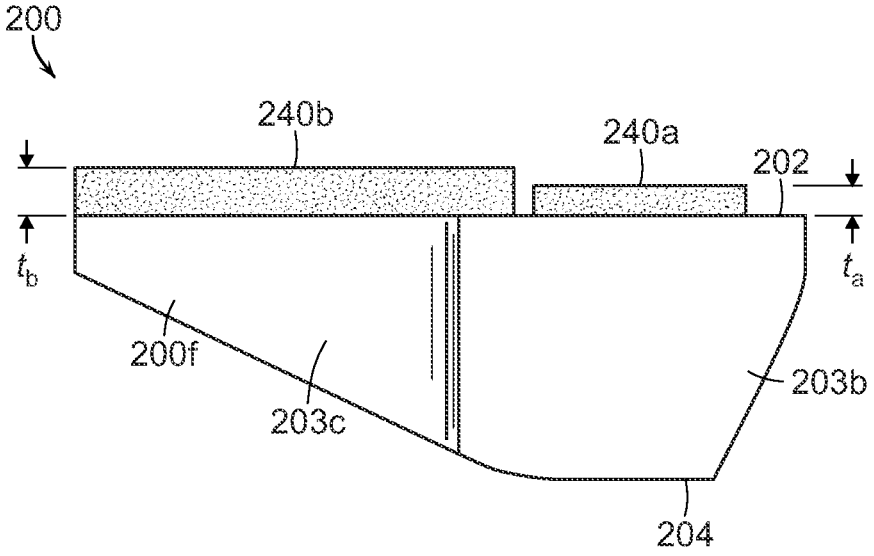
FIG. 7I is a perspective side view of the covering element of FIG. 7A showing the difference in thickness of the pieces of double-sided tape.

As best shown in FIG. 7I and as also shown in FIG. 7E, the first piece of double-sided tape 240*a* has a thickness ($t_a$) that differs from the thickness ($t_b$) of the second piece of double-sided tape 240*b*. In this particular embodiment, the thickness of tape 240*a* is less than the thickness of tape 240*b*. Selecting a specific thickness of the double-sided tape 240 may also be used to tailor the dynamic response of the ball striking plate 26. For example, it is expected that providing a piece of relatively thin tape 240 would generally provide less damping than if the tape were thicker. Further, a relatively thin tape 240 may result in more vibrational energy being transmitted to the covering element 200 and thus more interaction between the covering element 200 and the ball striking plate 26. Even further, selectively providing a region of the rear surface of the covering element 200 devoid of tape may also be used to tailor the dynamic response of the ball striking plate 26.

Additionally, the material of the double-sided tape 240 may be selected to specifically tailor the dynamic response of the ball striking plate 26. Different material may have different damping coefficients. For example, it is expected that a piece of relatively dense tape 240 would generally provide less damping than if the tape were less dense. A less dense tape may have a greater percentage of void volume and may more easily deform. Thus, in the specific embodiment of FIGS. 7A-7I, the first piece of double-sided tape 240*a* (or other adhesive member) positioned behind the expected point of impact may be provided with a different density than the second piece of tape 240*b* (or other adhesive member) more removed from the expected point of impact. (The density of tape such as double-sided tape is generally provided by the manufacturers in specification data sheets for the tapes.) In certain embodiments, the piece of double-sided tape positioned behind the expected point of impact may be provided with a lower density (e.g., foam have a greater volume of voids relative to the volume of the material surrounding the voids) than the piece of double-sided tape more removed from the expected point of impact. For example, it may be advantageous to position a relatively soft (i.e., spongier and less resistant to deformation) piece of double-sided tape behind the expected point of impact as compared to the piece of tape more removed from the expected point of impact. In other embodiments, the double-sided tape positioned behind the expected point of impact may have a different resiliency than the tape more removed from the expected point of impact. Resilience is the ability of a material to absorb energy when it is elastically deformed and to release that energy upon unloading. In even other embodiments, the double-sided tape positioned behind the expected point of impact may provide a different damping factor than the tape more removed from the expected point of impact. Damping is a measure of the dissipation of mechanical energy in the structure which leads to a reduction in mechanical vibration. In some embodiments, the double-sided tape positioned behind the expected point of impact may have a different thickness than the tape more removed from the expected point of impact. For example, the second piece of double-sided tape 240*b* positioned closer to the edge of the ball striking plate 26 may be provided with a greater thickness than the first piece of tape 240*a*. This may provide a more compliant attachment in the region where the ball striking plate 26 is expected to flex more. Such greater compliance in the affixing means may prevent the covering element 200 from being detached (e.g., popped off) during the impact event.

As described above, in general, covering element 200 may have any surface topography, including flat, substantially flat, rolling, mounded, stepped, embossed, sculpted, high-relief, etc. Covering element may have any thickness, including constant, gradually varying, stepped, contoured, etc.

Further, covering element 200 may have any surface texture, including shiny, reflective, matte, flat, granular, rough, etc. Surface textures may be provided by coating (or partially coating) covering element 200, including by painting, sealing, printing, dipping electroplating, nanocoating, etc. Surface textures may be provided by mold surfaces, polishing, buffing, sanding or other machining processes, etching, etc. Further, covering element 200 may have any material color, including opaque, translucent, transparent, etc. Opaque materials are impenetrable to visible light such that items may not be viewed through the material. Translucent materials allow at least some visible light to be transmitted such that items may be viewed through the material. Transparent materials are a subset of translucent materials that allow the majority of visible light to be transmitted and which are colorless. Substantially transparent materials are transparent materials that are substantially colorless, but may have some minor tinting. Thus, translucent, transparent, or substantially transparent matrix materials may allow certain features of the ball striking plate 26, for example, to be visible (or at least partially visible) through the thickness of the covering element 200.

According to some embodiments, the material used to form a covering element 200 may generally have a lower modulus of elasticity, i.e. be more elastic and/or resilient, than the materials used to form the ball striking plate 26. For example, a covering element 200 may be formed of a polymeric material formed of a thermosetting type resin or a thermoplastic type resin. By way of non-limiting examples, the polymeric material may include polyester resins, epoxy resins, phenolic resins, phenol-aldehyde resins, furan resins, urea formaldehyde resins, melamine resins, acetylene and poly-olefin resins, silicone resins, and the like. According to other embodiments, the polymeric material may include polyphenylene sulfides (PPS), polyacrylic acid (PAA), cross-linked polyethylene (PEX, XLPE), polyethylene (PE), polyethylene terephthalate (PET, PETE), polyphenyl ether (PPE), polyvinyl chloride (PVC), polyvinylidene chloride (PVDC), polylactic acid (PLA), polypropylene (PP), polybutylene (PB), polybutylene terephthalate (PBT), polyamide (PA), polyimide (PI), polycarbonate (PC), polytetrafluoroethylene (PTFE), polyurethane (PU or TPU), polyester (PEs), acrylonitrile butadiene styrene (ABS), poly(methyl methacrylate) (PMMA), polyoxymethylene (POM), polysulfone (PES), styrene-acrylonitrile (SAN), ethylene vinyl acetate (EVA), styrene maleic anhydride (SMA), PEBAX, etc. These polymeric materials may be supplied in powdered or liquid form, or in solution. Even further, the polymeric material may include bulk molding compound (BMC) polymers. Still further, the polymeric material may be a rubber-type material. Thus, according to some embodiments, the polymeric material used to form the covering element 200 may include natural rubber, synthetic rubber, silicone rubber, combinations thereof, etc. Although it is expected that a solid material may be preferred, in the alternative, the material forming the covering element 200 may be foamed. Example foams may include polyethylene foams, polypropylene foams, structural ABS foams, rigid polyurethane foams, polystyrene foams, and phenolic foams. As an example, the polymeric material may have a Shore D hardness of from 60 to 100.

Although polymeric materials may be most suitable for easily and efficiently forming a lightweight covering element 200, other suitable materials, including metals, glasses, composites, ceramics, wood, inks (for 3-D printing), etc., as would be apparent to persons of ordinary skill in the art given the benefit of this disclosure, may be used to form all or part of a covering element. Further, covering element may be formed by any suitable process, for example, injection molding, compression molding, laminating, extruding, casting, machining, 3-D printing, etc.

According to some embodiments, a striking plate 26 of a multi-piece golf club head 14 may be in the form of a substantially planar face plate, an L-shaped face member, a cup-face member, or another form. In other embodiments, a set of golf irons may have structures as described herein with the longer irons (e.g. 4-7) being formed of two pieces, including a striking plate 26 and a frame 28 joined by welding, and the shorter irons (e.g. 8, 9, P, S, A) being formed of a cast or forged single piece. For example, a single-piece head 14 may be made from 17-4 stainless steel, whereas a two-piece head

14 may be made with the frame 28 formed from 17-4 stainless steel and the striking plate 26 formed of 455 or 465 stainless steel.

The ball striking plate 26 as shown and described herein may be constructed from a wide variety of different materials, including materials conventionally known and used in the art, such as steel, titanium, aluminum, tungsten, graphite, polymers, or composites, or combinations thereof. More specific examples of such materials that may be used to form ball striking plate 26, including thickened portions 130, include those described above, including high strength stainless steels such as C455 and C465, other stainless steels such as 17-4, other steels such as maraging steels (e.g. Maraging 250) or AerMet steels, high strength titanium alloys such as 6-4, SP700, 8-1-1, 15-3-3-3, and 2041, PEEK polymer with or without fiber reinforcement, amorphous "liquid metal" alloys, bulk modulus composites, etc. High strength alloys and other materials having yield strengths of approximately 230-240 ksi or greater and ultimate strengths of approximately 250-260 ksi or greater may be desirable. In one embodiment, the striking plate 26 of a fairway wood or hybrid-type club may be made from C465 alloy having a yield strength of at least 240 ksi and an ultimate tensile strength of at least 260 ksi. In another embodiment, the ball striking plate 26 of a driver wood-type club may be made from a high strength titanium alloy (e.g. 6-4) having a yield strength of approximately 120-150 ksi or greater and an ultimate tensile strength of approximately 130-165 ksi or greater. In a further embodiment, the plate 26 of a driver wood-type club may be made from a 15-3-3-3 titanium alloy that may have a yield strength of approximately 145-181 ksi or greater and an ultimate tensile strength of approximately 165-200 ksi or greater.

The body 15 of golf club head 14 may also be constructed of various materials such as steel, titanium, aluminum, tungsten, graphite, polymers, plastics, composites or the like. It is understood that the body 15 may be unitarily formed as a single piece or as separate pieces that are joined together. For example, the body 15 may be formed as separate pieces (i.e., the frame 28, a hosel 22, etc.) which are subsequently joined by integral joining techniques, such as welding, cementing, or adhesively joining Other known techniques for joining these parts can be used as well, including many mechanical joining techniques, such as releasable mechanical engagement techniques.

The reduction in weight of the ball striking plate 26 achieved by efficiently channeling loads and selectively stiffening portions of the plate 26 may result in an increase in the coefficient of restitution (COR). Alternatively or in addition, the COR may be set at the prevailing USCA limit (e.g., 0.83) while reducing the weight of the club head, improving the dynamic response and/or improving the durability of the ball striking plate. Even further, the area of the ball striking plate 26 having the highest COR may be increased, such that even off-center hits may result in increased energy being transferred to the ball, thereby increasing the distance of the shot.

Any of the embodiments of ball striking devices 10, golf club heads 14, ball striking plates 26, covering elements 200, and other components described herein may include any of the features described herein with respect to other embodiments described herein, unless otherwise noted. The specific sizes, shapes, orientations, and locations of various components of the ball striking devices 10 and heads 14 described herein are simply examples, and any of these features or properties may be altered in other embodiments. The desired shapes, orientations, configurations, materials, etc. of the thickened portions 130 and/or other portions of the ball striking plate 26 may be altered to achieve different impact physics or to account for changes to other portions of the ball striking device. Similarly, the desired shapes, orientations, configurations, materials, etc. of the covering element 200 may be altered to achieve different effects or to account for changes to other portions of the ball striking device. Further, different types of ball striking devices may be manufactured according to the principles described herein.

In general, golf club head 14 may be any driver, wood, hybrid, iron, wedge, putter or the like. The golf club head 14 of FIGS. 1-5 may be representative of an iron-type golf club head according to the invention. The shape and design of the golf club head 14 may be dictated by the intended use of the device 10. For example, a golf club head 14 having a relatively large volume and an enclosed cavity may be suitable for use as a driver or wood-type golf club, which is intended to hit the ball accurately over long distances. When configured as a driver-type golf club, the head 14 may have a volume of at least 400 cc, and in some structures, at least 450 cc, or even at least 460 cc. In other applications, such as for a different type of golf club, the head may be designed to have different dimensions and configurations. For example, the head 14 suitable for use as a wedge-type golf club may have a smaller cavity or no inner cavity at all. Golf clubs and golf club heads may have any desired constructions, materials, dimensions, loft angles, lie angles, colors, designs, and the like without departing from this invention, including conventional constructions, materials, dimensions, loft angles, lie angles, colors, designs, and the like, as are known and used in the art.

Thus, while there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. A ball striking device comprising:

a ball striking plate having a front surface configured to strike a ball and a rear surface opposite the front surface; and a covering element located behind the rear surface of the ball striking plate, wherein the covering element is affixed to the rear surface of the ball striking plate with a first double-sided tape having a first thickness and with a second double-sided tape having a second thickness, wherein the first double-sided tape covers a first region of the rear surface of the ball striking plate and wherein the second double-sided tape covers a second region of the rear surface of the ball striking plate, wherein the first region generally corresponds to a thickened portion projecting from the rear surface of the ball striking plate, wherein the first region and the second region are separated by a third region of the rear surface of the ball striking plate, wherein the third region is devoid of an adhesive member, and wherein the third region generally corresponds to a region of the ball striking plate having a varying thickness.

2. The ball striking device of claim 1, wherein the first double-sided tape has a first density and the second double-sided tape has a second density.

3. The ball striking device of claim 1, wherein the double-sided tape covers substantially the entire surface of the first covering element that faces the rear surface of the ball striking plate.

4. The ball striking device of claim 1, wherein the first region is positioned behind a desired-contact region of the ball striking plate, and wherein the first double-sided tape is softer than the second double-sided tape.

5. The ball striking device of claim 1, wherein the first region is positioned behind a desired-contact region of the ball striking plate, and wherein the first double-sided tape has a density that is less than a density of the second double-sided tape.

6. The ball striking device of claim 1, wherein the ball striking plate has a frame extending rearwardly from the perimeter, and wherein the covering element is located within a cavity encompassed by the frame.

7. The ball striking device of claim 6, wherein the covering element, when viewed from the back of the ball striking device, extends across the opening of the cavity.

8. The ball striking device of claim 1, wherein the thickened portion has a shape, and wherein the first double-sided tape has substantially the same shape as the thickened portion and is affixed to the thickened portion.

9. The ball striking device of claim 8, wherein the shape of the thickened portion is one of a peanut-shape or a kidney-shape.

10. The ball striking device of claim 1, wherein the covering element includes an exterior surface having a multi-level surface topography with a plurality of abrupt changes in the slope of the surface.

11. The ball striking device of claim 1, wherein the covering element is a highly-contoured element having a maximum-to-minimum height ratio of greater than or equal to 5.

12. The ball striking device of claim 1, wherein the covering element is a highly-contoured element having a maximum-to-minimum height ratio of greater than or equal to 8.

13. The ball striking device of claim 1, wherein the covering element is a highly-contoured element having a maximum-to-minimum height ratio of greater than or equal to 10.

14. The ball striking device of claim 1, wherein the covering element is a shell-like element having a shell height-to-shell thickness ratio greater than 2.

15. The ball striking device of claim 1, wherein the covering element is a shell-like element having a shell height-to-shell thickness ratio greater than 8.

16. The ball striking device of claim 1, wherein the covering element is a shell-like element having a shell height-to-shell thickness ratio greater than 13.

17. The ball striking device of claim 1, further including a body connected to the ball striking plate to thereby form a golf club head, the body configured for engagement to a shaft.

18. A ball striking device comprising:

a ball striking plate having a front surface configured to strike a ball and a rear surface opposite the front surface; and a covering element affixed to the rear surface of the ball striking plate, wherein the covering element is a highly-contoured element having a maximum-to-minimum height ratio of greater than or equal to 5, and wherein the covering element is a shell-like element including a cavity, and wherein a scaffolding type structure provided within the cavity.

19. The ball striking device of claim 18, wherein the covering element is a highly-contoured element having a maximum-to-minimum height ratio of greater than or equal to 8.

20. The ball striking device of claim 18, wherein the covering element is a highly-contoured element having a maximum-to-minimum height ratio of greater than or equal to 10.

21. The ball striking device of claim 18, wherein the covering element is a shell-like element having a shell height to shell thickness ratio greater than 4.

22. The ball striking device of claim 18, wherein the covering element weighs less than 12.0 gm.

23. The ball striking device of claim 18, wherein the covering element extends over a majority of the rear surface of the ball striking plate.

24. The ball striking device of claim 18, wherein the covering element is affixed to the rear surface of the ball striking device with a first double-sided tape having a first thickness and with a second double-sided tape having a second thickness.

25. The ball striking device of claim 18, wherein the covering element is affixed to the rear surface of the ball striking device with a first double-sided tape having a first density and with a second double-sided tape having a second density.

26. The ball striking device of claim 18, wherein the first double-sided tape covers a first region of a surface of the covering element that faces the rear surface of the ball striking plate and wherein the second double-sided tape covers a second region of the surface of the covering element that faces the rear surface of the ball striking plate, wherein the first region and the second region are separated by a third region of the surface of the covering element that faces the rear surface of the ball striking plate, and wherein the third region is devoid of double-sided tape.

27. The ball striking device of claim 26, wherein the first region corresponds to a thickened portion projecting from the rear surface of the ball striking plate and positioned behind a desired-contact region of the ball striking plate, and wherein the first double-sided tape is softer than the second double-sided tape.

28. The ball striking device of claim 26, wherein the third region generally corresponds to a transition region of the ball striking plate having a varying thickness.

29. A covering element for affixation to a golf club, the covering element comprising;

a first surface configured for placing an adhesive member; and a second surface having a multi-level surface topography with a plurality of abrupt changes in the slope of the surface;

wherein the covering element weighs less than 12.0 grams, wherein the covering element is a shell like element, wherein the covering element includes a cavity, and wherein a scaffolding type structure is provided within the cavity.

30. The covering element of claim 29, wherein the covering element is a highly-contoured element having a maximum-to-minimum height ratio of greater than or equal to 5.

31. The covering element of claim 29, wherein the covering element is a highly-contoured element having a maximum-to-minimum height ratio of greater than or equal to 8.

32. The covering element of claim 29, wherein the covering element is a highly-contoured element having a maximum-to-minimum height ratio of greater than or equal to 10.

* * * * *